US010967664B2

(12) United States Patent
Nishizawa et al.

(10) Patent No.: US 10,967,664 B2
(45) Date of Patent: Apr. 6, 2021

(54) MULTILAYERED BODY, PRODUCING METHOD FOR MULTILAYERED BODY, AND PRINTING SYSTEM

(71) Applicant: MIMAKI ENGINEERING CO., LTD., Nagano (JP)

(72) Inventors: Ryo Nishizawa, Nagano (JP); Akira Takatsu, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 16/517,677

(22) Filed: Jul. 22, 2019

(65) Prior Publication Data

US 2020/0031152 A1 Jan. 30, 2020

(30) Foreign Application Priority Data

Jul. 25, 2018 (JP) ..... JP2018-139841
Jun. 11, 2019 (JP) ..... JP2019-108835

(51) Int. Cl.
*B41M 5/50* (2006.01)
*B41M 5/00* (2006.01)
*B41M 7/00* (2006.01)

(52) U.S. Cl.
CPC ..... *B41M 5/0058* (2013.01); *B41M 5/0047* (2013.01); *B41M 5/50* (2013.01); *B41M 7/0081* (2013.01); *B41M 2205/40* (2013.01)

(58) Field of Classification Search
None
See application file for complete search history.

(56) References Cited

U.S. PATENT DOCUMENTS 8,777,352 B2 * 7/2014 Sakai ..... B41J 2/145 347/12
2004/0005471 A1 1/2004 Sugita et al.
2010/0055424 A1 3/2010 Yoshida et al.

FOREIGN PATENT DOCUMENTS

EP 2945362 11/2015
JP 2011194610 10/2011
WO 2007033031 3/2007

OTHER PUBLICATIONS

"Partial Search Report of Europe Counterpart Application", dated Dec. 19, 2019, p. 1-p. 16.
"Search Report of Europe Counterpart Application", dated Aug. 21, 2020, p. 1-p. 15.

* cited by examiner

*Primary Examiner* — Alejandro Valencia
(74) *Attorney, Agent, or Firm* — JCIPRNET

(57) ABSTRACT

A multilayered body includes a base material with a metal tone glossy layer having metal tone glossiness, and a color layer layered on the metal tone glossy layer. The color layer has an arithmetic mean height and a transmission density located in a region below a straight line represented as ($y=-0.1067x+0.8$) on coordinates of the arithmetic mean height x and the transmission density y.

3 Claims, 10 Drawing Sheets

(A) First print information

| I D | Print condition | Preview data |
|---|---|---|
| A 1 | Ejection amount of C: a1, ejection amount of M: b1, ... irradiation mode A | Image A1 |
| A 2 | Ejection amount of C: a2, ejection amount of M: b2, ... irradiation mode A | Image A2 |
| A 3 | Ejection amount of C: a3, ejection amount of M: b3, ... irradiation mode A | Image A3 |

⋮

(B) Second print information

| I D | Print condition | Preview data |
|---|---|---|
| B 1 | Ejection amount of C: p1, ejection amount of M: q1, ... irradiation mode C | Image B1 |
| B 2 | Ejection amount of C: a2, ejection amount of M: b2, ... irradiation mode B | Image B2 |
| B 3 | Ejection amount of C: a3, ejection amount of M: b3, ... irradiation mode C | Image B3 |

⋮

FIG. 10

MULTILAYERED BODY, PRODUCING METHOD FOR MULTILAYERED BODY, AND PRINTING SYSTEM

CROSS REFERENCE TO RELATED APPLICATIONS

This application claims the priority benefits of Japanese Patent Application No. 2018-139841, filed on Jul. 25, 2018, and Japanese Patent Application No. 2019-108835, filed on Jun. 11, 2019. The entirety of each of the above-mentioned patent applications is hereby incorporated by reference herein and made a part of this specification.

TECHNICAL FIELD

The present disclosure relates to a multilayered body, a producing method for the multilayered body, and a printing system.

DESCRIPTION OF THE BACKGROUND ART

A technique of forming a metallic glossy surface or a submetallic glossy surface (hereinafter, also collectively referred to as a metal tone glossy surface) on the surface of various members has been developed to improve designability. As such a technique, Japanese Unexamined Patent Publication No. 2011-194610 (Patent Literature 1) discloses a method for forming a metallic glossy surface by printing with a metallic ink.

Patent Literature 1: Japanese Unexamined Patent Publication No. 2011-194610.

SUMMARY

The inventors of the present disclosure found that colored metal tone glossiness can be obtained by printing a color layer of an appropriately controlled mode on the metal tone glossy surface (e.g., may be a surface of a metal plate, a metal film formed through evaporation and the like other than that formed by the technique of Japanese Unexamined Patent Publication 2011-194610).

The present disclosure provides a multilayered body having a colored metal tone glossiness, a producing method for the multilayered body having the colored metal tone glossiness, and a printing system capable of producing the multilayered body having the colored metal tone glossiness.

A multilayered body according to a first aspect of the present disclosure includes a base material including a metal tone glossy surface having a metal tone glossiness; and a color layer layered on the metal tone glossy surface, where the color layer has an arithmetic mean height and a transmission density located in a region below a straight line represented as ($y=-0.1067x+0.8$) on coordinates of the arithmetic mean height x and the transmission density y.

According to the above configuration, a colored metal tone glossiness can be obtained by the color layer having the above characteristics.

The color layer layered on the metal tone glossy surface may be formed to cover the metal tone glossy surface, or may be provided on a part of the metal tone glossy surface (hereinafter, the same applies to the color layer layered on the metal tone glossy surface). The metallic glossy surface of the base material may be, for example, at least a part of at least one surface of the base material (hereinafter, the same applies to the metal tone glossy surface).

The color layer may have $\Delta L^*$ of greater than or equal to 10 and Log HAZE of greater than or equal to 300.

According to the above configuration, a colored metal tone glossiness can be obtained by the color layer having the above characteristics.

The arithmetic mean height and the transmission density of the color layer may be located in a region below a straight line represented as ($y=-0.133x+0.8$) on the coordinates.

According to the above configuration, a colored metal tone glossiness can be obtained by the color layer having the above characteristics.

The base material may include a base member, and a metal tone glossy layer formed on the base member with metallic ink and having the metal tone glossy surface.

According to the above configuration, a colored metal tone glossiness can be obtained by providing the metal tone glossy layer. The metal tone glossy layer may be provided, for example, on at least a part of at least one surface of the base member.

A multilayered body according to a second aspect of the present disclosure includes a base material including a metal tone glossy surface having a metal tone glossiness; and a color layer layered on the metal tone glossy surface, where the color layer has an arithmetic mean height and a transmission density located in a region below a straight line represented as ($y=-0.0625x+0.8$) on coordinates of the arithmetic mean height x and the transmission density y.

According to the above configuration, a colored metal tone glossiness can be obtained by the color layer having the above characteristics.

The color layer may have $\Delta L^*$ of greater than or equal to 35 and Log HAZE of greater than or equal to 700.

According to the above configuration, a colored metal tone glossiness having a matte tone can be obtained by the color layer having the above characteristics.

The color layer may have Rspec of greater than or equal to 50.

According to the above configuration, a colored metal tone glossiness having a mirror-surface tone can be obtained by the color layer having the above characteristics.

The color layer may include a first part in which $\Delta L^*$ is greater than or equal to 35 and Log HAZE is greater than or equal to 700, and a second part in which Rspec is greater than or equal to 50.

According to the above configuration, the metal tone glossiness of different texture can be expressed by the first part and the second part.

In the base material, at least the metal tone glossy surface may be made of metal.

According to the above configuration, the metal tone glossiness can be easily obtained as the metal tone glossy surface is made of metal. The base material may be, for example, made of a metal, or may have a metal film and the like forming a metal tone glossy surface formed on a non-metal base material.

A multilayered body according to a third aspect of the present disclosure includes a base material including a metal tone glossy surface having a metal tone glossiness; and a color layer layered on the metal tone glossy surface, where the color layer has at least a part formed to a thickness that allows transmission of light reflected by the metal tone glossy surface and adds color to the metal tone glossiness.

According to the above configuration, a colored metal tone glossiness can be obtained as the color layer can transmit light.

The color layer may have an irregular shape, at least a recess transmitting light reflected by the metal tone glossy surface.

According to the above configuration, a colored metal tone glossiness can be obtained as the recess can transmit light.

A producing method for a multilayered body according to a fourth aspect of the present disclosure includes a first process of preparing a base material including a metal tone glossy surface having a metal tone glossiness; and a second process of printing a color layer on the metal tone glossy surface through an inkjet method, where in the second process, at least a part of the color layer is formed to a thickness that allows transmission of light reflected by the metal tone glossy surface.

According to the above configuration, a colored metal tone glossiness can be obtained by the color layer capable of transmitting light.

The second process may include a 2-1 process of selecting any of a plurality of print conditions prepared in advance for printing the color layer for adding color to the metal tone glossiness, and a 2-2 process of printing the color layer based on the print condition selected in the 2-1 process.

According to the above configuration, a colored metal tone glossiness can be easily obtained by using the print conditions prepared in advance.

The first process may include a selecting process of selecting which of (1) a first base material including a base member, and a metal tone glossy layer formed on at least a part of the base member with metallic ink and having the metal tone glossy surface, and (2) a second base material including a metal part forming the metal tone glossy surface to use as the base material, each of the plurality of print conditions when the first base material is selected in the selecting process may be a condition for printing the color layer including an arithmetic mean height and a transmission density located in a region below a straight line represented as ($y=-0.1067x+0.8$) on the coordinates of the arithmetic mean height x and the transmission density y, and each of the plurality of print conditions when the second base material is selected in the selecting process may be a condition for printing the color layer including an arithmetic mean height and a transmission density located in a region below a straight line represented as ($y=-0.0625x+0.8$) on the coordinates of the arithmetic mean height x and the transmission density y.

According to the above configuration, the color layer can be printed under suitable print conditions for obtaining a colored metal tone glossiness according to the material of the metal tone glossy surface.

A printing system according to a fifth aspect of the present disclosure includes a printing mechanism configured to perform printing with a radiation curable ink through an inkjet method on a metal tone glossy surface having a metal tone glossiness; and a print control section that controls the printing mechanism to print a color layer on the metal tone glossy surface with the printing mechanism, where the print control section prints the color layer such that at least a part of the color layer has a thickness that allows transmission of light reflected by the metal tone glossy surface.

According to the above configuration, a colored metal tone glossiness can be obtained by the color layer capable of transmitting light.

The print control section may acquire at least one print condition among a plurality of print conditions from a storage that stores the plurality of print conditions for printing the color layer that adds color to the metal tone glossiness, and prints the color layer based on the acquired at least one print condition.

According to the above configuration, the user does not need to set the print conditions, and a colored metal tone glossiness can be easily obtained.

The print conditions may be editable by a user, and the print control section may print the color layer based on the edited print condition.

According to the above configuration, a metal tone glossiness colored to the user's preference can be easily obtained.

Each of the plurality of print conditions may be a condition for printing the color layer including an arithmetic mean height and a transmission density located in a region below a straight line represented as ($y=-0.1067x+0.8$) on coordinates of the arithmetic mean height x and the transmission density y.

According to the above configuration, a colored metal tone glossiness can be obtained by the color layer having the above characteristics.

Each of the plurality of print conditions may be a condition for printing the color layer including an arithmetic mean height and a transmission density located in a region below a straight line represented as ($y=-0.0625x+0.8$) on the coordinates of the arithmetic mean height x and the transmission density y.

According to the above configuration, a colored metal tone glossiness can be obtained by the color layer having the above characteristics.

The plurality of print conditions may include one or more first print conditions acquired by the print control section when a base material including the metal tone glossy surface is a first base material including a base member, and a metal tone glossy layer formed on at least a part of the base member with metallic ink and having the metal tone glossy surface, and one or more second print conditions acquired by the print control section when the base material is a second base material including a metal part forming the metal tone glossy surface, and at least one of the one or more first print conditions and at least one of the one or more second print conditions may be different.

According to the above configuration, a colored metal tone glossiness can be obtained according to the material of the metal tone glossy surface.

The one or more first print conditions may include a condition for printing the color layer including an arithmetic mean height and a transmission density located in a region below a straight line represented as ($y=-0.1067x+0.8$) on the coordinates of the arithmetic mean height x and the transmission density y (all the first print conditions are preferably such conditions), and the one or more second print conditions may include a condition for printing the color layer including an arithmetic mean height and a transmission density located in a region below a straight line represented as ($y=-0.0625x+0.8$) on the coordinates of the arithmetic mean height x and the transmission density y (all the second print conditions are preferably such conditions).

According to the above configuration, the color layer can be printed under suitable print conditions for obtaining colored metal tone glossiness according to the material of the metal tone glossy surface.

According to the present disclosure, a multilayered body having a colored metal tone glossiness, a producing method for a multilayered body having a colored metal tone glossiness, and a printing system capable of producing a multilayered body having a colored metal tone glossiness can be provided.

BRIEF DESCRIPTION OF THE DRAWINGS

FIG. 10 is a view showing the contents of first print information (A in FIG. 10) and second print information (B in FIG. 10) according to the third embodiment of the present disclosure.

DESCRIPTION OF EMBODIMENTS

First Embodiment (Producing Method for Multilayered Body and Printed Matter)

Figure 1:
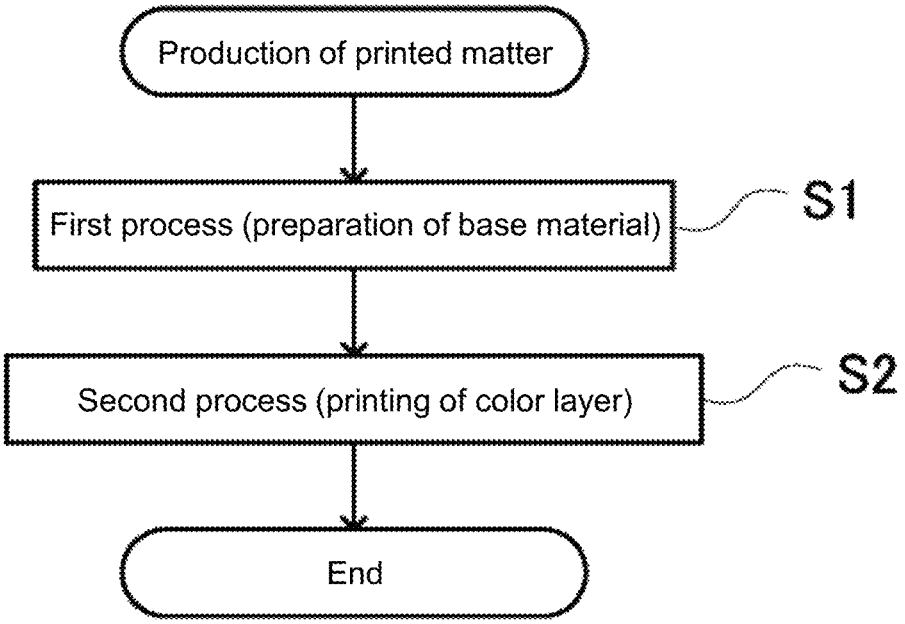
FIG. 1 is a flowchart of a producing method for a printed matter according to a first embodiment of the present disclosure.

A producing method for a multilayered body (printed matter) according to a first embodiment of the present disclosure will be described. As shown in FIG. 1, the present producing method includes a first process S1 of preparing a base material including a metal tone glossy surface, and a second process S2 of printing a color layer on the metal tone glossy surface. The metal tone glossiness includes metallic glossiness and submetallic glossiness.

Figure 2:
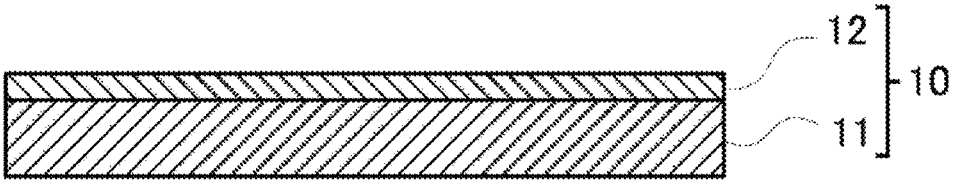
FIG. 2 is a schematic cross-sectional view of a base material according to the first embodiment of the present disclosure.

The base material prepared in the first process S1 merely needs to a base material including a metal tone glossy surface having metal tone glossiness. For example, a base material 10 in which a metal tone glossy layer 12 having metal tone glossiness (metallic glossiness or submetallic glossiness) is formed with a metallic ink on a sheet 11 made of synthetic resin is prepared, as shown in FIG. 2. The base material 10 may be a metal plate, or may be a member in which a metal film is formed as the metal tone glossy layer 12 by plating, vapor deposition or the like on a predetermined member. The sheet 11 may not be made of synthetic resin. For example, it may be paper, fabric or the like.

Figure 3:
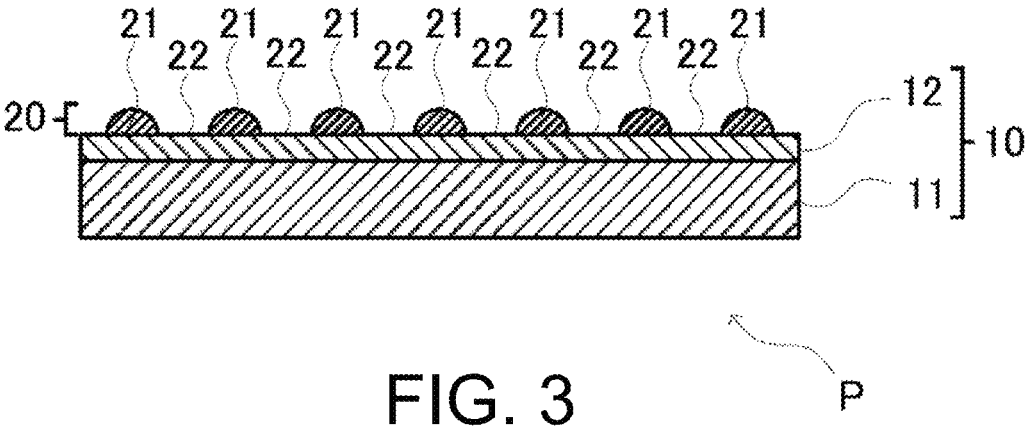
FIG. 3 is a schematic cross-sectional view of a printed matter in which a color layer is provided on the base material according to the first embodiment of the present disclosure.

In the second process S2, a color layer 20 is printed on the metal tone glossy layer 12 of the base material 10 with an ultraviolet (UV) curable ink having a predetermined color. Thus, as shown in FIG. 3, a printed matter P in which the color layer 20 is printed on the base material 10 is formed. The color layer 20 forms an image. That is, in the second process S2, the image represented by the color layer 20 is printed. The color layer 20 may be a single color, or two or more colors may be used.

The ultraviolet (UV) curable ink contains a polymerization initiator and a resin (acrylate etc.) such as a monomer or an oligomer which is polymerized by being irradiated with ultraviolet light, in addition to the coloring material which becomes the color of the color layer.

Figure 4A:
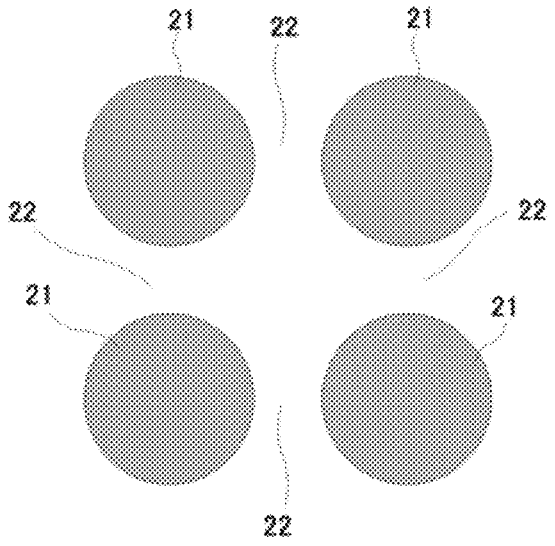
FIGS. 4A and 4B are schematic views showing the formation pattern of dots.

The color layer 20 is formed through an inkjet method by an inkjet printer. The UV-curable ink ejected through the inkjet method is cured and fixed to the base material 10, thus forming the color layer 20. The color layer 20 is formed from a plurality of (multiple) dots 21 that constitute an image. Each dot 21 is formed by causing one or more drops of the UV-curable ink ejected from the print head of the inkjet printer to land on a predetermined portion of the base material 10, and then curing and fixing the ink by ultraviolet irradiation. A gap 22 is formed between the dots 21. The gap 22 may be formed by separating the adjacent dots 21 from each other as shown in FIG. 4A, or may be formed between partially overlapping dots 21 as shown in FIG. 4B.

The metal tone glossy layer 12 is exposed from the gaps 22 of the dots 21. The dot 21 does not transmit light reflected (e.g., regular reflection) by the metal tone glossy layer 12, but the gap 22 (part where the thickness of the color layer 20 is "0". This part is also a part of the color layer 20) transmits the light reflected (e.g., regular reflection) by the metal tone glossy layer 12. Therefore, a person who looks at the printed matter P (hereinafter, also referred to as an observer) visually recognizes the metal tone glossy layer 12 through the gap 22 together with the dots 21 of the color layer 20. The printed matter P is thus visually recognized to have the metal tone glossiness (color metallic glossiness) of the color of the dot 21 (color of the color layer 20). In particular, by making the gaps 22 fine to an extent that they cannot be confirmed or difficult to be confirmed with the naked eye, the printed matter P is visually recognized to have a metal tone glossiness in which the part provided with the color layer 20 is uniformly colored.

The way the printed matter P appears can be controlled by adjusting the size of the gap 22 (size when the color layer 20 etc. are seen in plan view; similarly the size etc. of the dots 21). If the gap 22 is too large, the dots 21 become rough, and the coloring cannot be seen uniformly, or the colored color cannot be visually recognized (especially when the dots 21 are small). Furthermore, if the gap 22 is too small, the majority of the metal tone glossy layer 12 will be hidden by the dots 21 and the metal tone glossiness will be lost.

Figure 4B:
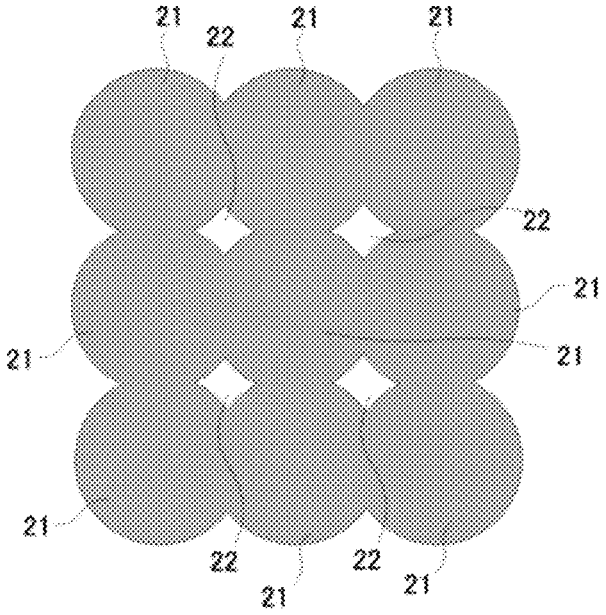

When the dots 21 and the dots 21 are connected as shown in FIG. 4B, a thin film part which is a connected part (overlapping part) may have a thickness of transmitting the light reflected (e.g., regular reflection) by the metal tone glossy layer 12. This also allows it to be visually recognized so as to have a colored metal tone glossiness. Furthermore, in both FIGS. 4A and 4B, the dots 21 may be formed to a thickness capable of transmitting the light (in the case of FIG. 4B, parts other than the thin film part as well). In the case of FIG. 4B, the dot 21 transmits less light than the thin film part. This also allows it to be visually recognized so as to have a colored metal tone glossiness.

The color layer 20 may have an arithmetic mean height and a transmission density located in a region below the straight line represented as ($y=-0.1067x+0.8$) on the coordinates of the arithmetic mean height x and the transmission density y. In other words, the arithmetic mean height x and the transmission density y of the color layer 20 preferably satisfy the relationship of $y<-8/75x+0.8$. Furthermore, $\Delta L^*$ of the color layer 20 after being layered on the base material 10 may be greater than or equal to 10 (more preferably greater than or equal to 10 and smaller than or equal to 25), and Log HAZE may be greater than or equal to 300 (more preferably greater than or equal to 400). Furthermore, the arithmetic mean height and the transmission density of the color layer 20 are more preferably located in a region below the straight line represented as ($y=-0.133x+0.8$) on the coordinates. In other words, the arithmetic mean height x and the transmission density y of the color layer 20 preferably satisfy the relationship of $y<-2/15x+0.8$. In order to have such characteristics, the ejection amount of the UV-curable ink per dot (the larger the amount, the larger the diameter of one dot), the density of the dots (the number of dots per unit area), and the period from when the UV-curable ink is ejected to land on the base material 10 until the ink is cured (if the period is long, the ink spreads during that period, so the gap 22 becomes small, and the thin film part becomes thick) are preferably adjusted. The color layer 20 preferably has a reflection density of greater than or equal to 0.5.

The arithmetic mean height (Sa) is a parameter in which Ra (arithmetic mean height of line) is extended to a plane, and represents the mean of the absolute value of the difference in height of each point with respect to the mean plane of the surface, where the roughness of the surface is larger the higher the value. The arithmetic mean height (Sa) can be measured by, for example, a shape analysis laser microscope manufactured by KEYENCE Co.: model number VK-X200 Series or the like.

The transmission density becomes higher the lesser the object (color layer 20) does not transmit light. Assuming that the incident light flux is I0 and the transmitted light flux is I, the transmission density Dr is calculated by $-\log 10\ (I/I0)$. There are two types of transmission density: parallel light density that causes light to hit the object perpendicularly and measures the light transmitted in the perpendicular direction from the object and diffused light density that measures the transmitted light in all directions, but the transmission density in the present specification is the parallel light density. The transmission density can be measured, for example, using a D200-II transmission densitometer manufactured by Sakata Inx Eng. Co. Ltd., or a 361T table-type transmission densitometer manufactured by X-Rite Inc.

When the transmission density of the color layer 20 is low, the metal tone glossiness of the base material 10 is visually recognized and a metal feeling is obtained, so the transmission density is preferably as low as possible. On the other hand, when the arithmetic surface height is large, diffused reflection occurs on the surface of the color layer 20 thus losing the metal feeling and the color feeling (the metal tone glossiness may not appear or the color of the color layer 20 may not be visible). Therefore, preferred metal feeling and color feeling can be obtained when the arithmetic mean height x and the transmission density y of the color layer 20 satisfy the relationship of $y<-8/75x+0.8$. More preferred metal feeling and color feeling can be obtained when the arithmetic mean height x and the transmission density y of the color layer 20 satisfy the relationship of $y<-2/15x+0.8$. As described above, although it is preferable that the transmission density is basically as low as possible, if the transmission density is too low, the coloring degree lowers and the color feeling may be lost. Therefore, the transmission density is preferably greater than or equal to 0.01, and more preferably greater than or equal to 0.05.

The value of $\Delta L^*$ is measured as follows. First, an axis perpendicular to a measurement sample surface (a surface to be printed of the color layer) is assumed as 0° (reference), and the light irradiated from the light source placed at each position of 25°, 45°, and 75° from 0° is reflected with the surface to be printed and the reflected light is received at the position of 0° to measure the brightness. Here, the brightness obtained by reflecting the light from each light source with the surface to be printed is assumed as L25 (for a 25° light source), L45, (for a 45° light source), L75 (for a 75° light source), and the brightness difference between L25 and L75 is calculated as $\Delta L^*$. This value can be measured, for example, by a spectrophotometer manufactured by Konica Minolta Inc.

The HAZE value of Log HAZE is the haze (unit: HAZE UNIT (HU)) as measured at an incident light angle of 20° based on ASTM E430/ISO 13803. This value can be measured, for example, by RHOPOINT-IQ manufactured by Konica Minolta Inc. or Micro Haze Plus manufactured by BYK Gardner Co. The value of Log HAZE is determined by Log HAZE=1285×log [(HAZE value/20)+1] (where, log is a common logarithm). The reflection image on the measurement surface (color layer 20) is hazier (the color layer 20 is irregular) the higher the Log HAZE value, and the contrast of the reflection image on the measurement surface (color layer 20) is higher (the color layer 20 is not irregular) the lower the Log HAZE value.

The reflection density becomes higher the more the object (color layer 20) reflects light. Assuming that the incident light flux is I0 and the reflected light flux is I, the reflection density Dr is calculated by $-\log 10\ (I/I0)$. The reflection density can be measured, for example, by a 500 series spectrodensitometer manufactured by X-Rite Inc.

(Inkjet Printer)

Figure 7:
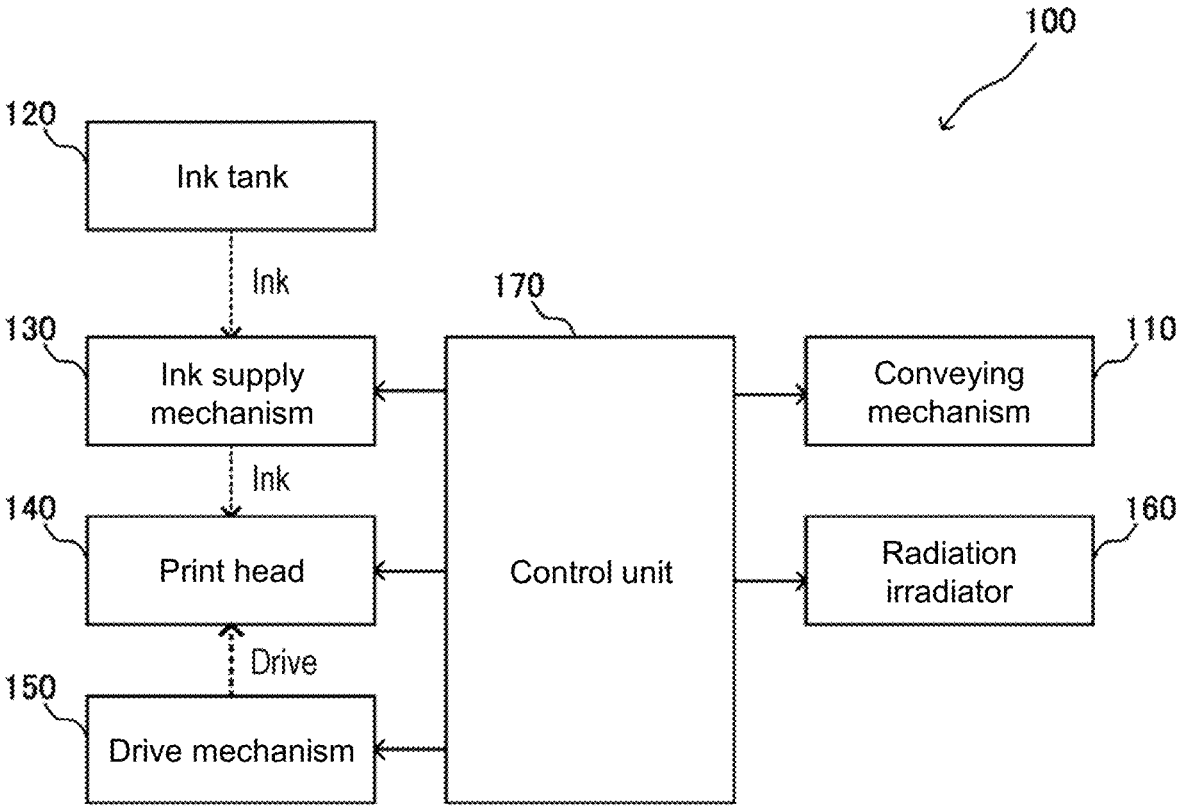
FIG. 7 is a schematic configuration view of an inkjet printer according to the first embodiment of the present disclosure.

For example, an inkjet printer 100 shown in FIG. 7 may be used as an inkjet printer for printing the color layer 20. The inkjet printer 100 includes a conveying mechanism 110, an ink tank 120, an ink supply mechanism 130, a print head 140, a drive mechanism 150, a radiation irradiator 160, and a control unit (controller) 170.

The conveying mechanism 110 conveys the base material 10 along the front and back direction. The conveying mechanism 110 is configured by a belt conveyor. The conveying mechanism 110 may include a table on which the base material 10 is placed and a drive mechanism that drives the table.

The ink tank 120 is an ink cartridge or an ink bottle that stores radiation curable ink (e.g., UV-curable ink), and is attached to the inkjet printer 100.

The ink supply mechanism 130 is a mechanism for supplying the radiation curable ink in the ink tank 120 to the print head 140. The ink supply mechanism 130 includes a sub tank that stores the radiation curable ink, a supply pipe that supplies the radiation curable ink in the ink tank 120 to the sub tank, a circulation pipe that forms a circulation path for circulating the radiation curable ink stored in the sub tank through the print head 140, a valve that controls the circulation of the radiation curable ink in the circulation path, and a driving device that drives the valve.

The print head 140 ejects the radiation curable ink supplied from the ink supply mechanism 130 through an inkjet method and applies the ink to the base material 10. The print head 140 includes a storage chamber for storing the ink circulating in the circulation path of the ink supply mechanism 130, a piezoelectric element or heater for pushing out the radiation curable ink stored in the storage chamber, and a nozzle for ejecting the radiation curable ink pushed out. A plurality of sets of storage chambers, piezoelectric elements or heaters, and nozzles may be arranged along the main scanning direction described later. Thus, the radiation curable ink can be ejected simultaneously for a plurality of pixels lined in the main scanning direction.

The drive mechanism 150 moves the print head 140 in a direction orthogonal to the conveyance direction (sub scanning direction) of the base material 10. The drive mechanism 150 includes a carriage on which the print head 140 is mounted, and a moving mechanism that moves the carriage in the main scanning direction orthogonal to the sub scanning direction. The moving mechanism is configured to include a guide rail that movably supports the carriage in the main scanning direction, a traction cord for pulling the carriage, and a winding mechanism for winding the traction cord (one set is disposed at each end of the guide rail).

The radiation irradiator 160 includes a light or the like for irradiating the radiation curable ink landed on the base material 10 with radiation (e.g., ultraviolet light). The radiation irradiator 160 is mounted on the carriage described above.

The control unit 170 controls the conveying mechanism 110 (e.g., the belt conveyor or drive mechanism), the ink supply mechanism 130 (e.g., the driving device), the print head 140 (e.g., the piezoelectric element or heater), and the drive mechanism 150 (e.g., the above-mentioned winding mechanism) and the light irradiator 160, and performs a printing process of applying the radiation curable ink on the base material 10.

In order to perform the process, the control unit 170 is configured to include a storage device (hard disk, flash memory, etc.) that stores programs and various data, a processor (central processing unit (CPU) etc.) that executes the program stored in the storage device and uses the various data to actually execute the printing process, a main memory of the processor, and various interfaces. The control unit 170 may be, for example, a personal computer.

(Printing Process)

The printing process is started when image data is provided from an external host computer or the like. The image data includes data on the presence or absence of ejection of the radiation curable ink for each pixel. Although the ejection amount of ink is made constant here, the ejection amount may be changed according to the pixel.

First, the control unit 170 controls the conveying mechanism 110 to move the base material 10 to a printing start position. Next, the control unit 170 controls the drive mechanism 150 to move the print head 140 in the main scanning direction at a constant conveyance speed relative to the base material 10. During this movement, the control unit 170 controls the print head 140 to eject the radiation curable ink in the form of droplets from the nozzles at the timing the nozzles of the print head 140 reach the position (designated by the image data) of the pixel to eject the radiation curable ink. Meanwhile, the radiation irradiator 160 is moved following the print head 140 to irradiate the radiation curable ink landed on the base material 10 with radiation and cure (fix) the radiation curable ink. The curing timing of the radiation curable ink can be controlled by the distance between the radiation irradiator 160 and the nozzle of the print head 140 (i.e., the size of the gap 22 and the thickness of the thin film part can be controlled by the spread degree of the ink). The interval between the landing of the ink on the base material 10 and the irradiation of the radiation may be, for example, 1 to 60 seconds, more preferably 20 to 30 seconds.

Thereafter, the control unit 170 controls the conveying mechanism 110 to feed the base material 10 by one pixel in the sub scanning direction. Then, the control unit 170 causes the print head 140 to eject ink while moving in the sub scanning direction as described above to print the second line. The control unit 170 repeats the above to print each line. The entire color layer 20 (image) is printed by printing each row. Thus, the control unit 170 controls the relative movement of the print head 140 with respect to the base material 10 (the base material 10 may be moved) to print one of the color layers 20.

The print head 140 may be provided with a plurality of nozzles along the main scanning direction, in which case the control unit 170 feeds a medium in the main scanning direction by the number of pixels of the number of nozzles.

In addition to adjusting the curing timing of the UV-curable ink according to the distance between the radiation irradiator 160 and the nozzle of the print head 140, and the like, by controlling the interval for ejecting the ink (dot density) and the amount of ink per dot on the control unit 170 side, the size of the gap 22 and the thickness of the thin film part can be controlled, whereby each numerical value such as $\Delta L^*$ can be controlled, and the way the printed matter P appears (such as the coloring degree with respect to metal tone glossiness) can also be controlled.

First Modified Example

Figure 5:
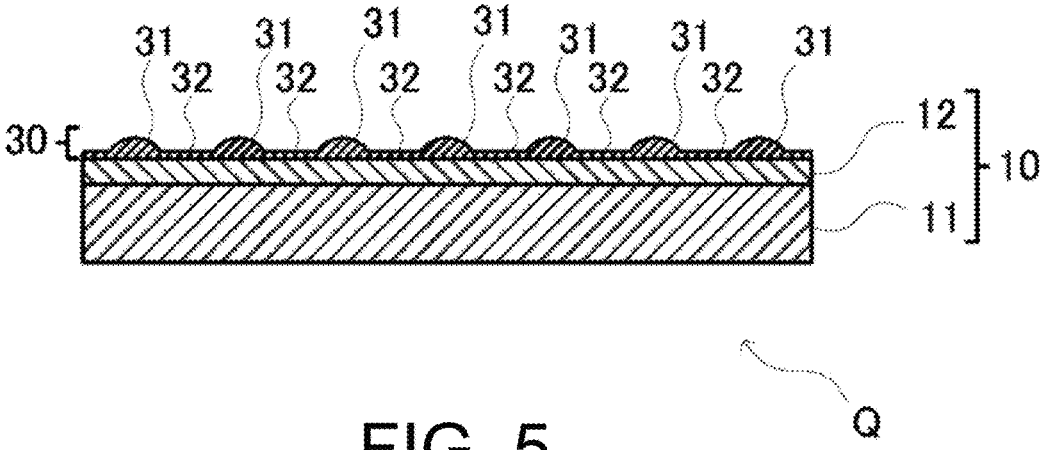
FIG. 5 is a schematic cross-sectional view of a printed matter according to a modified example.

As another mode of the printed matter P, a printed matter Q as shown in FIG. 5 may be formed. The printed matter Q includes a color layer 30 in place of the color layer 20. The color layer 30 includes a thin film part 32 connecting the dots 31 in addition to the dots 31 corresponding to the dots 21. The thin film part 32 is formed integrally with the dot 31 by a UV-curable ink. The thin film part 32 can be formed by taking a longer time from the landing of a drop of UV-curable ink from the print head 140 on the base material 10 to the irradiation of the UV-curable ink with the ultraviolet light than in the case of FIG. 3. As the time becomes longer, the UV-curable ink that forms each dot 31 spreads and connects accordingly, and the thin film part 32 can be formed. The thin film part 32 may be formed even if the amount of ink per dot is increased or the dot density is increased in addition to or in place of the adjustment of the time. Irregularities are formed by the thin film part 32 and the dot part 31. The thickness of the thin film part 32 is formed to a thickness that allows light transmission, and the metal tone glossy layer 12 transmits the reflected (e.g., regular reflection) light. The observer visually recognizes the metal tone glossy layer 12 through the thin film part 32 together with the dots 31 of the color layer 30. Thus, the printed matter Q is visually recognized to have the metal tone glossiness of the color of the dots 31 (the color of the color layer 30). In particular, the printed matter Q is visually recognized to have a metal tone glossiness in which the part provided with the color layer 30 is uniformly colored by making the irregularities formed by the thin film part 32 and the dots 31 fine to an extent they cannot be confirmed or difficult to be confirmed with the naked eye. The dots 31 may also be formed to a thickness that allows light transmission. In this case, the dots 31 transmit less light than the thin film part 32. Even in such a case, the printed matter Q is visually recognized to have the metal tone glossiness of the color of the dots 31 (the color of the color layer 30).

Second Modified Example

Figure 6:
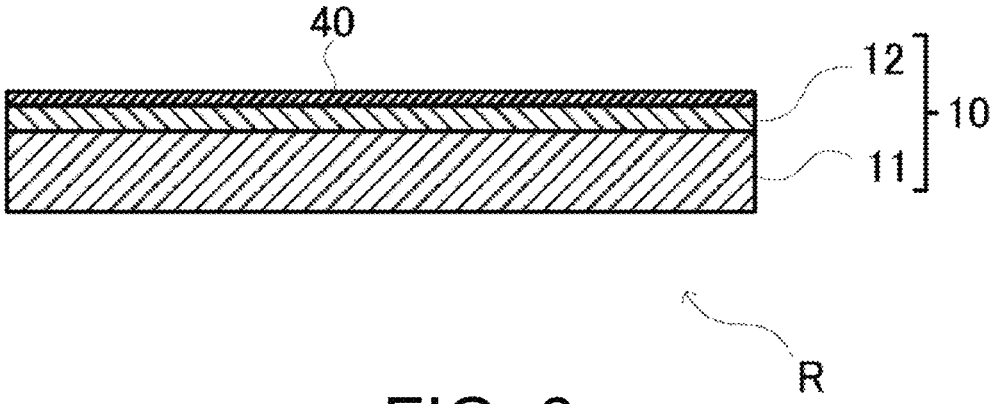
FIG. 6 is a schematic cross-sectional view of a printed matter according to a modified example.

As another mode of the printed matter P, a printed matter R as shown in FIG. 6 may be formed. The printed matter R includes a color layer 40 in place of the color layer 20. The color layer 40 is a flat layer having a uniform thickness. The color layer 40 can be formed by taking a longer time from the landing of a drop of UV-curable ink from the print head 140 on the base material 10 to the irradiation of the UV-curable ink with the ultraviolet light than in the cases of FIGS. 3 and 5. As the time becomes longer, the UV-curable ink constituting each dot is spread and connected accordingly, and the irregularities are ultimately eliminated, whereby the thickness of the color layer 40 obtained by curing the UV-curable ink becomes uniform. The color layer 40 may be formed even if the amount of ink per dot is increased or the dot density is increased in addition to or in place of the adjustment of the time. The thickness of the color layer 40 is formed to a thickness that allows light transmission, and the metal tone glossy layer 12 transmits the reflected (e.g., regular reflection) light. The observer visually recognizes the metal tone glossy layer 12 through the color layer 40. Thus, the printed matter R is visually recognized so as to have the metal tone glossiness of the color of the color layer 40.

Third Modified Example

The color layer 30 and the color layer 40 also preferably have similar characteristics as the above-described characteristics of the color layer 20 (the arithmetic mean height x and the transmission density y satisfy the relationship of $y<-8/75x+0.8$, etc.).

Fourth Modified Example

The ink used to form the color layers 20, 30, 40 is not limited to the UV-curable ink, and merely needs to be a radiation curable ink that cures by radiation. As the radiation curable ink, in addition to the UV-curable resin mentioned above, an electron beam curable resin that cures by electron beam and the like can be mentioned. Furthermore, the ink used to form the color layers 20, 30, 40 may be another type of ink printable by an inkjet printer, such as for example, an aqueous ink (includes a latex ink), a solvent ink, and the like. The inkjet printer 100 may be configured to be able to print such other types of ink.

Fifth Modified Example

The dot density of the color layers 20 and 30 may not be uniform. For example, an arbitrary pattern, for example, a gradation pattern may be formed on the color layers 20 and 30 by providing a portion having high dot density and a portion having low dot density. In this case, a metal tone glossiness having a color corresponding to the pattern, for example, a metal tone glossiness exhibiting a color gradation can be obtained.

Sixth Modified Example

A unit for layering the color layers 20, 30, 40 on the base material 10 is not limited to the inkjet printer, and any other layering device such as screen printing may be used as long as fine dots with a predetermined gap 22 can be formed.

Seventh Modified Example

Although the surface of the metal tone glossy layer 12 is shown flat in FIGS. 2, 3, 5, and 6, the surface of the metal tone glossy layer 12 may have irregularities. The irregularities of the surface of the metal tone glossy layer 12 may affect the parameters (e.g., the arithmetic mean height etc.) of the surface of the color layers 20, 30, 40 layered on the metal tone glossy layer 12, but this does not arise a problem if the parameters of the color layers 20, 30, 40 formed on the surface of the metal tone glossy layer 12 ultimately fall within the predetermined range mentioned above.

Second Embodiment

A second embodiment will be described below, but the description that is not referred to in the following description follows the description of the first embodiment and the modified examples (hereinafter referred to as the first embodiment and the like).

(Printed Matter)

Figure 8:
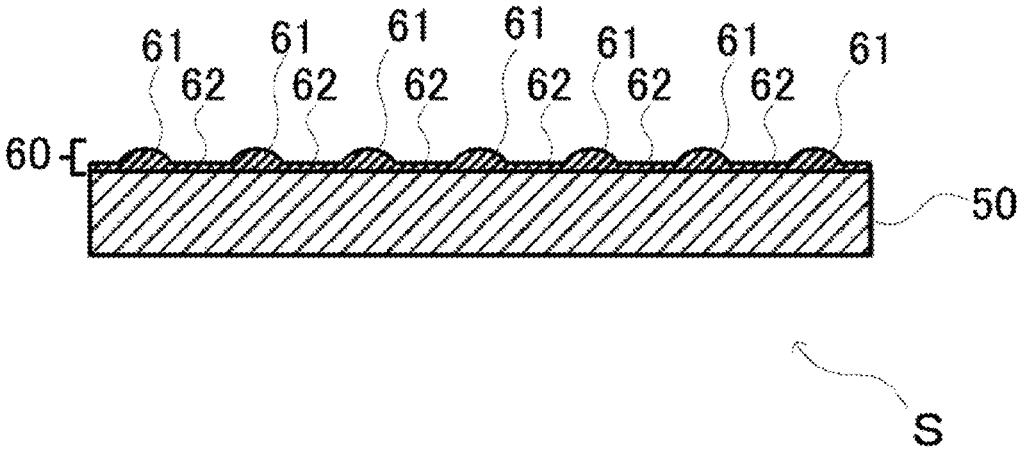
FIG. 8 is a schematic cross-sectional view of a printed matter in which a color layer is provided on a base material according to a second embodiment.

FIG. 8 shows a printed matter (multilayered body) S according to a second embodiment. The printed matter S includes a base material 50 and a color layer 60. The base material 50 is formed from a metal plate or the like made of metal. The surface of the base material 50 is a metal tone glossy surface having a metal tone glossiness (in this case, particularly a metal glossiness). The base material 50 may be a plate shape made of metal or a sheet shape made of metal, and may be a member in which a metal film is formed by plating, evaporation, and the like on a material other than metal, for example, a polyethylene terephthalate (PET) sheet, a synthetic resin sheet such as an acrylic plate, a paper, a fabric, and the like. For example, the surface of the base material 50 on which at least the color layer 60 is printed may be made of metal (includes the metal film). Aluminum, iron, copper, stainless steel and the like are mentioned for each metal.

Similar to the color layer 30, the color layer 60 is formed by printing through the inkjet method using an UV-curable ink. Similar to the color layer 30, the color layer 60 includes dots 61 which are protrusions and the thin film part 62 connected to the dots 61, respectively. The thin film part 62 is formed integrally with the dot 61 by a UV-curable ink. The thin film part 62 and the dots 61 form the irregularities. For the description of the color layer 60, the description of the color layer 30 can be referred to. The dot 61 corresponds to the dot 31 of the color layer 30, and the thin film part 62 corresponds to the thin film part 32 of the color layer 30. The color layer 60 may not have the gaps between the dots 61 as with the color layer 20, may have gaps like the color layer 20 (this gap is also a part of the color layer 60), or may be flat like the color layer 40 (for the description, the descriptions of the color layers 20 and 40 can be referred to). The color layer 60 (includes a case where the gap is provided and a case where it is flat) transmits a part of the light from the outside and reflects the other parts. Among the light from the outside, a part of the light transmitted through the color layer 60 is reflected by the metal tone glossy surface of the base material 50, transmitted again through the color layer 60, and exit to the outside of the color layer 60. When a part of the light transmitted through the color layer 60 and the light reflected by the color layer 60 enter the human eye, the printed matter S is visually recognized by the person with the same appearance as adding the color of the color layer 60 to the metal tone glossiness by the metal tone glossy surface (a colored metal tone glossiness is obtained).

The color layer 60 may have an arithmetic mean height and a transmission density located in a region below the straight line represented as ($y=0.0625x+0.8$) on the coordinates of the arithmetic mean height x and the transmission density y. In other words, the arithmetic mean height x and the transmission density y of the color layer 60 preferably satisfy the relationship of $y<-1/16x+0.8$. With such a relationship, the color layer 60 can add a color to the metal tone glossiness of the base material 50, and the metal tone glossiness colored by the color layer 60 is expressed (the above conditions are more relaxed in the case of the base material 50, that is, in the case where the metal tone glossiness of the base material 50 is expressed by metal than in the case of the base material 10). In addition to the above conditions ($y<-1/16x+0.8$), $\Delta L^*$ of the color layer 60 is preferably greater than or equal to 35 and Log HAZE is greater than or equal to 700. According to such a numerical value, the printed matter S is colored by the color layer 60 and has an appearance that has a metal tone glossiness having a rough texture (matte tone). Alternatively, in addition to the above condition ($y<-1/16x+0.8$), the Rspec of the color layer 60 may be greater than or equal to 50. According to such a numerical value, the printed matter S is colored by the color layer 60, and has an appearance that has a metal tone glossiness having a smooth texture (mirror surface tone). In order to have such characteristics, the ejection amount of the UV-curable ink per dot (the larger the amount, the larger the diameter of one dot), the density of the dots (the number of dots per unit area), and the period from when the UV-curable ink is ejected to land on the base material 50 until the ink is cured (if the period is long, the ink spreads during that period, so the gap between the dots becomes small, and the thin film part becomes thick) are preferably adjusted.

First Modified Example

At least a part of the surface of the base material 50 may be made of metal. The part made of metal may have a metal tone glossiness. The color layer 60 may be formed in a region of the base material 50 that includes at least a part of the part made of metal. The base material 50 may be of sheet-like or non-sheet-like.

Third Embodiment

A third embodiment will be described below, but the description that is not referred to in the following description follows the description of the first embodiment, the second embodiment and the modified examples (hereinafter also referred to as the second embodiment and the like).

(Printing System PS)

Figure 9:
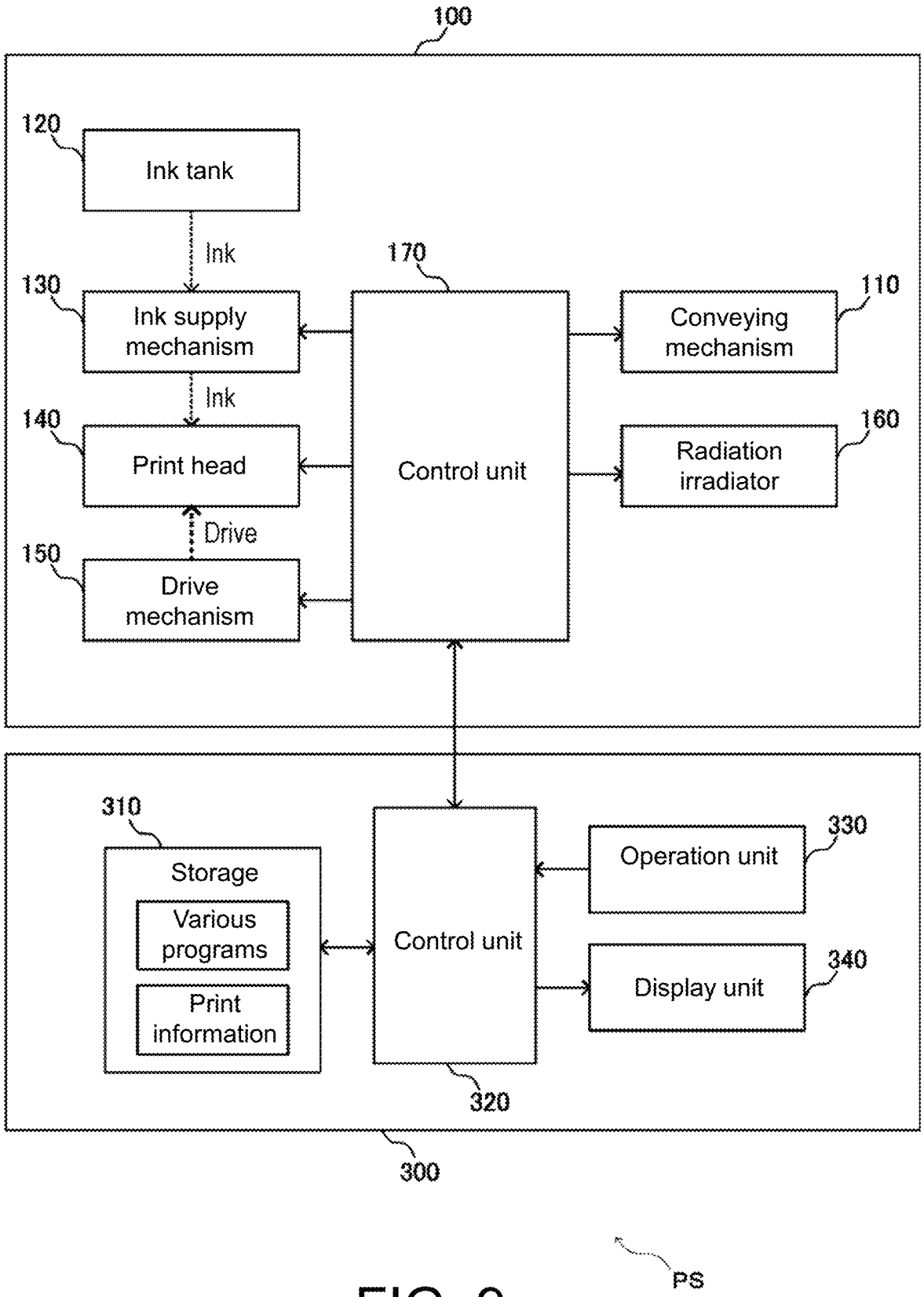
FIG. 9 is a schematic configuration view of an inkjet printer according to a third embodiment of the present disclosure.

The third embodiment relates to a printing system for forming one of the base material color layers. As shown in FIG. 9, a printing system PS according to the third embodiment includes the inkjet printer 100 described in the first embodiment and a computer 300. The printing system PS prints one of the color layers 20 to 40 on the base material 10 and the color layer 60 on the base material 50 to form one of the printed matters P to S. Hereinafter, the base materials 10 and 50 will be collectively referred to as the base material BS, and the color layers 20 to 40 and 60 will be collectively referred to as the color layer CL.

The first embodiment can be referred to for the description of the inkjet printer 100, and in particular, the ink tank 120 individually stores for each ink a plurality of radiation curable inks (e.g., a plurality of inks of different colors such as each color of CMYK (cyan, magenta, yellow, black)) for forming the color layer CL. The ink supply mechanism 130 individually supplies each of the plurality of radiation curable inks in the ink tank 120 to the print head 140. The print head 140 individually ejects each of the plurality of radiation curable inks supplied from the ink supply mechanism 130 through the inkjet method, and causes the ink to land on the base material 10 or 50. A plurality of sets of the storage chamber, the piezoelectric element or the heater and the nozzle may be provided along the sub scanning direction and/or the main scanning direction for each of a plurality of radiation curable inks. The ejection/non-ejection and the ejection amount of the radiation curable ink are individually controlled for each nozzle.

The computer 300 includes various computers including a personal computer, and includes a storage 310, a control unit 320, an operation unit 330, and a display unit 340. Here, the computer 300 is a host computer that controls the inkjet printer 100 (e.g., instructs printing).

The storage 310 includes a non-volatile storage device such as a hard disk, a solid state drive (SSD), or a flash memory. The storage 310 stores various programs, data indicating print information, and the like.

The various programs described above are executed by the control unit 320, whereby various processes are executed (details will be described later).

The print information includes print conditions (details will be described later) for when printing the color layer CL. The print conditions are selected by the user. The user is, for example, a worker who prints a printed matter using the printing system PS, and a purchaser of the printing system PS, and operates the computer 300 to cause the inkjet printer 100 perform printing. The color layer CL is printed based on the selected print conditions. An example of the print information is shown in FIG. 10. For the print information, the first print information used when the base material on which the color layer CL is to be printed is the base material 10 (the base material on which the metal tone glossy layer 12 is provided), and the second print information used when the base material is the base material 50 (base material made of metal) are prepared.

The storage 310 may store one or more (here, a plurality of) pieces of first print information and one or more (here, a plurality of) pieces of second print information. One piece of first print information and one piece of second print information each includes an ID, a print condition, and preview data. The ID, the print condition, and the preview image are stored in the storage 310 in association with each other for one piece of first print information and one piece of second print information.

The ID is information ("A1", "A2", "B1", "B2", etc.) for specifying each of the first print information and the second print information.

The print condition is a print condition when printing the color layer CL, and includes the ejection amount of each ink, the irradiation mode, and the like. The ejection amount is the information ("ejection amount of C", "ejection amount of M", etc.) that designates for each radiation curable ink (ink of CMYK here) the ejection amount of ink per dot from each nozzle of the print head 140 (e.g., when the amount of ink ejected in one ejection is quantitative, the ejection amount is defined by the number of times the ink is ejected). The irradiation mode is information for specifying a period from when the UV-curable ink is ejected to land on the base material BS until the ink is cured. In the inkjet printer 100, since the radiation irradiator 160 and the print head 140 move together in the main scanning direction, and hence the period can be changed by changing the moving speed according to the irradiation mode. Only the ejection of ink may be performed when moving the print head 140 and the radiation irradiator 160 one or more times in the main scanning direction at the same position in the sub scanning direction, and then the radiation may be irradiated when again moving the print head 140 and the radiation irradiator 160 once in the main scanning direction at the same position, in which case, the period from when the radiation curable ink is ejected and landed on the base material BS until the ink is cured can be adjusted by adjusting the standby time from the movement for ejection of ink until the movement for irradiation of the radiation. The print condition merely needs to be able to specify the conditions the characteristics of the color layer CL (arithmetic mean height, transmission density, ΔL*, Log HAZE, reflection density) become the desired conditions, and may include the number of dots per inch square, and the like. The print conditions are appropriately edited by the user.

Each print condition of all the first print information stored in storage 310 is preferably the condition for printing the color layers 20 to 40 having the arithmetic mean height and transmission density located in the region below the straight line represented as ($y=-0.1067x+0.8$) on the coordinates of arithmetic mean height x and transmission density y. Furthermore, each or at least one of the print conditions is preferably the condition for printing the color layers 20 to 40 in which ΔL* is greater than or equal to 10 (more preferably greater than or equal to 10 and less than or equal to 25) and Log HAZE is greater than or equal to 300 (more preferably greater than or equal to 400). Each or at least one of the print conditions is preferably the condition for printing the color layers 20 to 40 having an arithmetic mean height and transmission density located in a region below the straight line represented as ($y=-0.133x+0.8$) on the coordinates. Moreover, each or at least one of the print conditions is preferably the condition for printing the color layers 20 to 40 having a reflection density of greater than or equal to 0.5. Under these conditions, any of the color layers 20 to 40 that adds color to the metal tone glossiness of the base material 10 can be obtained.

Each print condition of all the second print information stored in storage 310 is preferably the condition for printing the color layer 60 having the arithmetic mean height and transmission density located in the region below the straight line represented as ($y=-0.0625x+0.8$) on the coordinates of arithmetic mean height x and transmission density y. In addition to this condition, each or at least one of the print conditions is preferably a condition for printing the color layer 60 in which (1) ΔL* of the color layer 60 is greater than or equal to 35, Log HAZE is greater than or equal to 700, or (2) Rspec of the color layer 60 is greater than or equal to 50. Under these conditions, any of the color layers 60 that adds color to the metal tone glossiness of the base material 10 can be obtained. The color layer 60 printed under the above condition (1) provides a metal tone glossiness having a rough (matt) texture. The color layer 60 printed under the above condition (2) provides a metal tone glossiness having a smooth (near mirror surface) texture. The print condition of all the second print information stored in the storage 310 may be either the condition of (1) or the condition of (2), or a part of the print condition may be the condition of (1), the other part may be the condition of (2) and a part of the remain may be the other one or more conditions. As described above, the plurality of print conditions of each of the plurality of second print information stored in the storage 310 preferably include the condition of (1) and the condition of (2), so that the metal tone glossiness of different textures can be expressed.

A part of the print conditions of the first print information and the print conditions of the second print information may be the same condition. However, the appearance of the metal tone glossiness to which color is added may be different between the base material 10 and the base material 50. The print condition may be common to the base material 10 and the base material 50. For example, only the first print information may be adopted (with the print condition for printing a color layer that produces colored metal tone glossiness on the base material 10 (metal tone glossy layer 12 made of metallic ink), a color layer that produces colored metal tone glossiness can be obtained even on the base material 50).

The above print conditions can be obtained by experiments or the like. Specifically, the color layer is printed on the base material BS under various print conditions, and among the various print conditions, a condition in which the printed color layer is the color layer CL (color layer CL that satisfies each condition above) that colors the metal tone glossiness of the base material BS (adds color without losing metal tone glossiness) is adopted as the print condition of each print information.

The preview image is an image representing the surface of any of the printed matters P to S, that is, the colored metal tone glossiness when the color layer CL is printed under the corresponding print conditions. The preview image is displayed on the display unit 340 as a reference when the user selects a print condition. The preview image may be, for example, a colored metal tone glossiness image obtained when the color layer CL is printed on a silver-color metal tone glossy surface. In this case, the metal tone glossy surface of the base material 10 and the base material 50 used for printing is preferably silver color in accordance with the preview image. Even when the base material 10 or the base material 50 used for printing is not silver color, the user can grasp the aspect of the metal tone glossiness after forming the color layer CL to some extent with reference to the preview image. In view of a case where the base material 10 and the base material 50 is a color other than silver color (e.g., copper color etc.), the data of each image representing the surface of any of the printed matters P to S, that is, the colored metal tone glossiness when the color layer CL is printed on each metal tone glossy surface of various colors may be prepared as the data of the image.

The control unit 320 executes the various programs stored in the storage 310 to actually execute the processes executed by the computer 300 (process for receiving selection of print conditions, process for displaying a preview image, process for editing print conditions, process for causing the inkjet printer 100 to print the color layer CL based on the print conditions etc.).

The operation unit 330 receives an operation of the user (operation of selecting a print condition, operation of editing a print condition, and the like). The operation unit 330 includes a keyboard, a mouse, and the like.

The display unit 340 displays the preview image and the like, and includes a liquid crystal display device and the like.

(Operation of Printing System PS)

Figure 11:
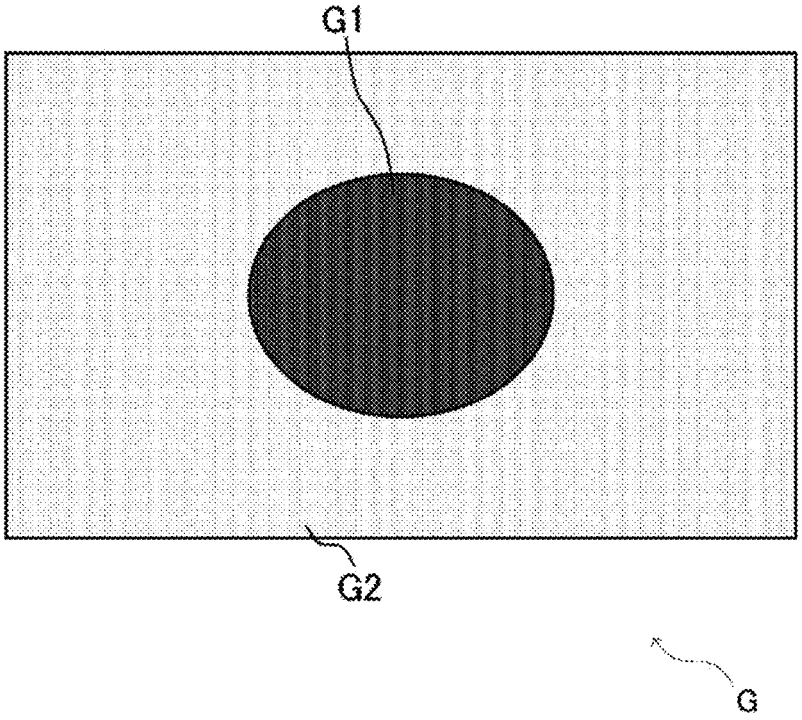
FIG. 11 is a view showing an example of an image printed by the inkjet printer according to the third embodiment of the present disclosure.

The operation of the printing system PS will be described below. Here, it is assumed that an original image G in FIG. 11 is prepared as an original image that becomes the source of the image represented by the color layer CL (image to be actually printed). The original image G is created by drawing software of the computer 300 or the like. The original image G includes a first image G1 and a second image G2 (e.g., a surrounding image adjacent to the first image G1). The original image G is not limited to the form shown in FIG. 11 and can take various forms.

Figure 12:
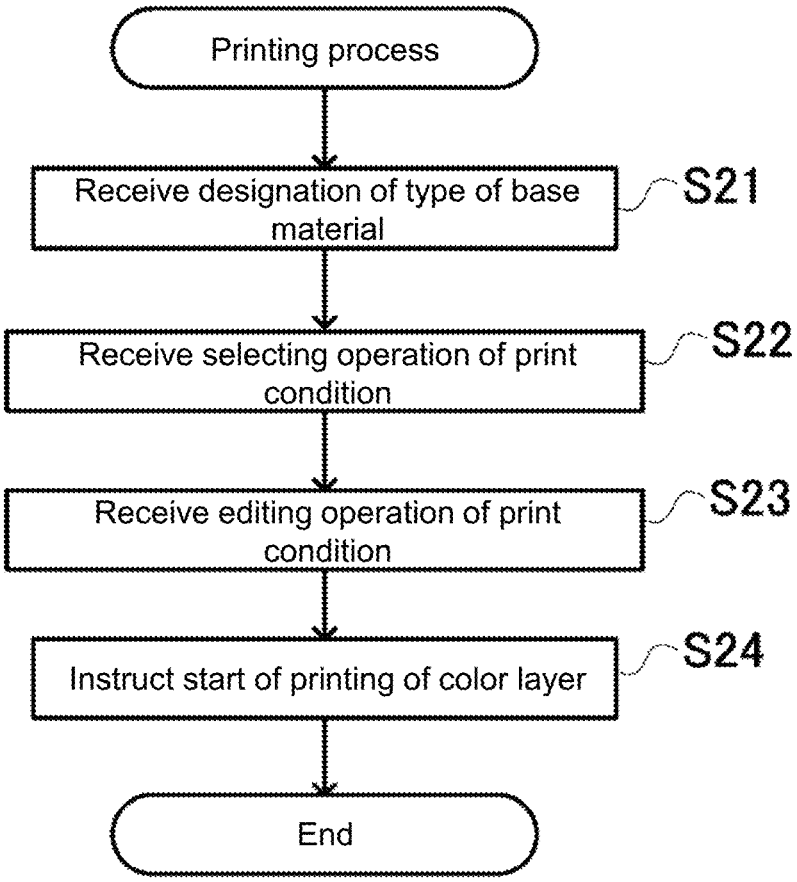
FIG. 12 is a flowchart of printing process executed by the inkjet printer according to the third embodiment of the present disclosure.

The control unit 320 of the computer 300 executes the printing process shown in FIG. 12 in accordance with the program stored in the storage 310. In addition, the base material 10 or the base material 50 is to be set in the inkjet printer 100 before the execution of the process.

In the printing process, the control unit 320 first displays on the display unit 340, a screen for selecting whether the base material set in the inkjet printer 100 is the base material 10 or the base material 50, and receives an operation by the user for selecting a base material using the operation unit 330 (step S21).

When the control unit 320 receives the selecting operation, the control unit 320 receives a selection of print conditions (step S22). Specifically, when the user selects the base material 10 using the operation unit 330, the control unit 320 displays the preview image included in each of the first print information on the display unit 340 together with the original image G. When the user selects the base material 50 using the operation unit 330, the control unit 320 displays the preview image included in each of the second print information on the display unit 340 together with the original image G. Thereafter, the control unit 320 receives an operation as to which print condition is to be applied to each part (the first image G1 and the second image G2) of the original image G (step S22). For example, the user moves a desired preview image to each part of the original image G by performing drag and drop using the operation unit 330. As a result, for each part, the print condition corresponding to the moved preview image is applied (selected) to the part of the movement destination.

When receiving the selection of the print condition, the control unit 320 displays the content of the print condition (in particular, the numerical value such as the ejection amount) on the display unit 340, and receives the editing operation of the print condition (step S23). The print conditions after being edited may be stored in the storage 310 as post-edit print conditions (may be selectable at the time of selection of print conditions after next time).

When the operation for ending the editing is performed without performing the editing operation, or when the editing operation is performed, the control unit 320 provides an instruction to print the original image G under the print conditions (in the case of no editing) selected in step S22 or under the post-edit print conditions to the inkjet printer 100 (step S24). For example, the control unit 320 creates new image data in which the print condition or the post-edit print condition is applied to each part of the original image G, and provides the created image data to the inkjet printer 100 together with an instruction to print. The control unit 170 of the inkjet printer 100 performs a printing operation based on the provided instruction (e.g., the image data) to print the color layer CL on the base material BS. Thus, printing of the color layer CL is performed in accordance with the print condition selected in step S22 or the post-edit print condition, and the image represented by the color layer CL is printed. Since the post-edit print conditions are based on the print conditions selected in step S22, printing of the color layer CL according to the post-edit print conditions can also be said to be printing based on the print conditions selected in step S22.

According to the above processes, for example, the base material set in the inkjet printer 100 is the base material 50 (a case where the print condition of the second print information is selected), a condition A below may be selected as the print condition of a part corresponding to the first image G1 of the image G in the color layer CL, and a condition B below may be selected as the print condition of a part corresponding to the second image G2 of the image G in the color layer CL. The condition A is a print condition for printing the color layer in which an arithmetic mean height and a transmission density are located in a region below the straight line represented as ($y=-0.0625x+0.8$) on the coordinates of the arithmetic mean height x and the transmission density y, the $\Delta L^*$ is greater than or equal to 35 and Log HAZE is greater than or equal to 700. The condition B is a print condition for printing the color layer in which an arithmetic mean height and a transmission density are located in a region below the straight line represented as ($y=-0.0625x+0.8$) on the coordinates of the arithmetic mean height x and the transmission density y, and Rspec is greater than or equal to 50. In the printed matter S in which the color layer CL is printed under each of such print conditions, the part of the first image G1 of the image G has a metal tone glossiness having a rough texture (matte tone), and the part of the second image G2 of the image G has a metal tone glossiness having a smooth texture (mirror surface tone). Therefore, the printed matter S has high designability in which the texture is different depending on each region where printing is performed or the position visually recognized by the observer. For example, the first image G1 and the second image G2 may be printed with the same color, for example, the same ink (when the color is expressed by a plurality of colors of ink, ink of an ejection amount of the same ratio for the first image G1 and the second image G2) and even in this case, the metal tone glossiness having similar color and different texture is obtained, and high designability is obtained. The first image G1 and the second image G2 may be printed with different colors, for example, different inks (when the same plurality of inks are used for the first image G1 and the second image G2, ink of an ejection amount of a different ratio) and even in this case, a metal tone glossiness having different colors and different textures is obtained, and high designability is obtained.

The image to be actually printed (the image represented by the color layer CL) is not limited to being created through the method as described above. For example, an image to be printed may be prepared, and a part to print with the color layer CL (that is, a part to express the colored metal tone glossiness) and its print conditions may be selected or input (include editing) by the user (part other than the part where the color layer CL is printed may be solidly colored, for example, so that metal tone glossiness does not appear) to create an image to be actually printed. Furthermore, the image to be printed above may be created in advance by drawing software or the like including the position of the color layer CL and the print condition thereof.

When the base material 10 is selected and the print condition of the first print information is selected, the first image G1 may be a part on which the color layer CL is printed, and the second image G2 may be a part on which the color layer CL is not printed. As described above, the color layer CL may be printed only on a part of the base material 10 and the base material 50, and the printing may not be performed on other parts.

According to the above configuration, in expressing the metal tone colors such as silver or stainless steel colors using the conventional inkjet metallic ink, various color tones can be expressed by printing of color layers using color inks. In the above configuration, rather than using a color metallic ink in which color ink is mixed in the metallic ink, the printing is performed using the color ink on one surface of the metal tone glossy surface prepared in advance, for example, the base material 10 in which the metal tone glossy surface is formed using metallic ink on a sheet of nonmetallic material such as a PET sheet or a paper, and one surface of the sheet-like base material 50 made of metal such as aluminum foil, so that the colored metal tone glossiness (color metal tone glossiness) can be expressed.

In the above description, since the print conditions for the base material 10 (the print conditions for the first print information) and the print conditions for the base material 50 (the print conditions for the second print information) are prepared, the color layer CL can be printed under suitable print conditions for obtaining the colored metal tone glossiness according to the material of the metal tone glossy surface of the base material. Furthermore, since the print conditions are prepared in advance, the user does not need to set the print conditions by himself/herself, and can easily obtain the printed matter having the colored metal tone glossiness. Furthermore, the preference of the user can be reflected as the print conditions can be edited. Moreover, as print conditions of the second print information, the condition for printing the color layer in which $\Delta L^*$ is greater than or equal to 35 and Log HAZE is greater than or equal to 700 and the condition for printing the color layer in which Rspec is greater than or equal to 50 are prepared, so that the colored metal tone glossiness having different textures (matte tone or mirror surface tone) is obtained. The color layer CL may be uniformly printed under one print condition, or may be printed under different print conditions according to the region on the base material 50 as described above.

First Modified Example

First, which one of the base material 10 including a base member (other than the sheet 11, it may be a non-sheet form) and a metal tone glossy layer 12 formed with metallic ink on at least a part of the base member and including a metal tone glossy surface, and the base material 50 including a metal part forming the metal tone glossy surface to use can be selected as a base material BS on which the color layer CL is to be printed. In such a case, the inkjet printer 100 may have a function of printing the metal tone glossy layer 12 with metallic ink, and when the base material 10 is selected, the sheet 11 of the base material 10 may be set in the inkjet printer 100, and the metal tone glossy layer 12 may be printed by the inkjet printer 100 to form the base material 10. When the base material 10 is selected, the color layer CL is preferably printed under the print conditions of the first print information, and when the base material 50 is selected, the color layer CL is preferably printed under the print conditions of the second print information.

Second Modified Example

The print information (print conditions etc.) may be stored in the inkjet printer 100 such as a storage device of the control unit 170. In this case, the selection and editing of the print conditions may be performed using the display unit and the operation unit provided in the inkjet printer 100. Furthermore, the print information may be stored exterior to the computer 300 such as a server configured to communicate with the computer 300, and may be provided to the computer 300 each time the print condition is selected.

The printing system PS may include a printing mechanism that performs printing through the inkjet method, and a print control section that controls the printing mechanism. When the print conditions and the like are stored in the computer 300 or exterior to the computer 300 such as a server, for example, the printing mechanism becomes the inkjet printer 100 and the print control section becomes the computer 300. When the print conditions and the like are stored in the inkjet printer 100, for example, the printing mechanism becomes a part other than the part storing the process and data of the control unit 170 and the like in the inkjet printer 100 (in particular, the print head 140, a part where the print head 140 is relatively moved with respect to the base material BS), and the print control section becomes a part that stores the process and data such as the control unit 170 and the like in the inkjet printer 100.

First Example (Preparation of Metal Glossy Base)

First, a glossy ink having the following composition was prepared.

Ultraviolet curing resin (manufactured by MIMAKI ENGINEERING CO., LTD. LH-100 clear ink) 95 parts by mass Aluminum pigment 5 parts by mass In the preparation of the glossy ink, first, a film made of polyethylene terephthalate having a smooth surface (surface roughness Ra of less than or equal to 0.02 μm) was prepared. Then, silicone oil was applied entirely to one side of the film. A film made of aluminum (hereinafter, also simply referred to as an "aluminum film") was formed on the side applied with the silicone oil using vapor deposition. Subsequently, the film formed with the aluminum film was placed in LH-100 clear ink (manufactured by MIMAKI ENGINEERING CO., LTD.) and irradiated with ultrasonic waves to peel and crush the aluminum film from the film. Next, this was input into a homogenizer and pulverized for about 8 hours to obtain a glossy ink in which scaly aluminum particles are dispersed. The concentration of aluminum particles in this glossy ink was 5% by weight.

Next, using an inkjet printer (manufactured by MIMAKI ENGINEERING CO., LTD., flat bed type (Model No. UJF-7151 plus)), the glossy ink was printed in a band shape on a flexible film (manufactured by HYNT Co. HK-31WF) under conditions of 600×900 dpi and 16 passes. In each pass, the flexible film was irradiated with ultraviolet light with a standby time of 19.00 seconds sequentially from the timing when the glossy ink was applied by the printer head. This metal glossy base had a Log HAZE of 384.2, an Sa (arithmetic mean height) of 0.76 μm, a coating film thickness of 4.56 μm, and an absolute reflectance of 26.76%.

(Single Color Printing)

Using a cyan UV-curable ink (manufactured by MIMAKI ENGINEERING CO., LTD., LH-100 cyan (C)), the above-mentioned metal glossy base was printed with an inkjet printer (UJF-7151 plus, manufactured by MIMAKI ENGINEERING CO., LTD.) according to the conditions shown in the table below to obtain a single color printing sample.

TABLE 1

| Sample | Number of drops | UV irradiation interval | Dot size | Film thickness |
|---|---|---|---|---|
| C1-1 | $4.4 \times 10^5$ | 26 seconds | 50 μm | 23 μm |
| C1-2 | $4.4 \times 10^5$ | 0 seconds | 60 μm | 46 μm |

TABLE 1-continued

| Sample | Number of drops | UV irradiation interval | Dot size | Film thickness |
|---|---|---|---|---|
| C1-3 | $4.4 \times 10^5$ | 26 seconds | 65 μm | 23 μm |
| C1-4 | $4.4 \times 10^5$ | 26 seconds | 75 μm | 24 μm |
| C1-5 | $5.4 \times 10^5$ | 26 seconds | 50 μm | 29 μm |
| C1-6 | $5.4 \times 10^5$ | 0 seconds | 60 μm | 30 μm |
| C1-7 | $5.4 \times 10^5$ | 26 seconds | 65 μm | 22 μm |
| C1-8 | $5.4 \times 10^5$ | 26 seconds | 75 μm | 27 μm |

(Print Conditions Common to Samples)

Head temperature: 45° C.

Printing environment temperature (including medium): 25° C.

In the table, "number of drops" indicates the number of dots per square inch. For example, in C1, printing is performed with the set value of the number of drops being 440,464, but as there is an error of several thousand between the set value and the actual measurement value, the significant figures of the number of drops in the table are two digits.

In the table, "UV irradiation interval" indicates the time taken for the ink droplet ejected from the inkjet nozzle to land on the medium and the landed ink droplet to be irradiated with ultraviolet light.

In the table, "dot size" indicates the diameter of one dot on the medium after UV curing. This diameter is an arithmetic mean value when measured using an optical microscope (model number: VH-X6000 Series, manufactured by KEYENCE Co.). The dot size was set to a predetermined size by adjusting the drive waveform of ink ejection in UJF-7151 plus.

In the table, "film thickness" indicates the thickness of the ink layer after ultraviolet curing formed on the medium. The film thickness was measured by a shape analysis laser microscope (model number VK-X200 Series, manufactured by KEYENCE Co.).

(Mixed Color Printing)

Furthermore, using cyan and magenta UV-curable inks (manufactured by MIMAKI ENGINEERING CO., LTD., LH-100 cyan (C) and LH-100 magenta (M)), printing was performed on the metal glossy base described above with the inkjet printer according to the conditions shown in the table below with a dot pattern in which the dot of each ink is alternately arranged to obtain a mixed color printing sample of blue. Similarly, using cyan, magenta, and yellow UV-curable inks (manufactured by MIMAKI ENGINEERING CO., LTD., LH-100 cyan (C), LH-100 magenta (M), and LH-100 yellow (Y)), a mixed color printing sample of process black was obtained. In the following table, a mixed color printing sample of blue is indicated by a combination of "B" and a number (for example, "B1"), and a mixed color printing sample of process black is indicated by a combination of "PB" and a number (for example, "PB1").

TABLE 2

| Sample | Number of drops | UV irradiation interval | Dot size | Film thickness |
|---|---|---|---|---|
| B1-1 | $6.0 \times 10^5$ | 26 seconds | 50 μm | 16 μm |
| B1-2 | $6.0 \times 10^5$ | 26 seconds | 75 μm | 22 μm |
| B1-3 | $8.8 \times 10^5$ pieces | 0 seconds | 60 μm | 40 μm |
| B1-4 | $8.8 \times 10^5$ pieces | 26 seconds | 65 μm | 19 μm |
| PB1-1 | $4.6 \times 10^5$ | 0 seconds | 60 μm | 40 μm |
| PB1-2 | $4.6 \times 10^5$ | 26 seconds | 65 μm | 22 μm |
| PB1-3 | $9.0 \times 10^5$ | 26 seconds | 50 μm | 17 μm |

TABLE 2-continued

| Sample | Number of drops | UV irradiation interval | Dot size | Film thickness |
|---|---|---|---|---|
| PB1-4 | $9.0 \times 10^5$ | 26 seconds | 75 μm | 27 μm |
| PB1-5 | $1.33 \times 10^6$ pieces | 0 seconds | 60 μm | 40 μm |
| PB1-6 | $1.33 \times 10^6$ pieces | 26 seconds | 65 μm | 30 μm |

In the mixed color printing, the "number of drops" indicates the total number of ink drops of all colors. Since the set value of the number of drops of ink of each color is the same, the number of drops per color is obtained by dividing the number of drops in the table by 2 (for blue) or 3 (for process black).

Second Example

The second example was carried out in the same manner as the first example except that the color layer was printed directly with color ink on a sheet-like base material (metal tone glossy surface made of metal) on which a metal film of aluminum was vapor-deposited on the surface of the PET sheet, and the single color printing and mixed color printing samples were obtained according to the conditions shown in the table below.

TABLE 3

| Sample | Number of drops | UV irradiation interval | Dot size | Film thickness |
|---|---|---|---|---|
| C2-1 | $4.4 \times 10^5$ | 0 seconds | 60 μm | 46 μm |
| C2-2 | $4.4 \times 10^5$ | 26 seconds | 65 μm | 23 μm |
| C2-3 | $4.4 \times 10^5$ | 26 seconds | 75 μm | 24 μm |
| C2-4 | $5.4 \times 10^5$ | 0 seconds | 60 μm | 30 μm |
| C2-5 | $5.4 \times 10^5$ | 26 seconds | 65 μm | 22 μm |
| C2-6 | $5.4 \times 10^5$ | 26 seconds | 75 μm | 27 μm |
| C2-7 | $1.5 \times 10^5$ | 26 seconds | 65 μm | 34 μm |
| C2-8 | $3.0 \times 10^5$ | 26 seconds | 65 μm | 25 μm |
| C2-9 | $1.5 \times 10^5$ | 0 seconds | 60 μm | 28 μm |
| C2-10 | $1.5 \times 10^5$ | 26 seconds | 75 μm | 27 μm |
| B2-1 | $6.0 \times 10^5$ | 26 seconds | 75 μm | 22 μm |
| B2-2 | $8.8 \times 10^5$ pieces | 0 seconds | 60 μm | 40 μm |
| B2-3 | $8.8 \times 10^5$ pieces | 26 seconds | 65 μm | 19 μm |
| B2-4 | $3.1 \times 10^5$ | 26 seconds | 65 μm | 22 μm |
| PB2-1 | $4.6 \times 10^5$ | 0 seconds | 60 μm | 40 μm |
| PB2-2 | $4.6 \times 10^5$ | 26 seconds | 65 μm | 22 μm |
| PB2-3 | $9.0 \times 10^5$ | 26 seconds | 75 μm | 27 μm |
| PB2-4 | $1.33 \times 10^6$ pieces | 0 seconds | 60 μm | 40 μm |
| PB2-5 | $1.33 \times 10^6$ pieces | 26 seconds | 65 μm | 30 μm |

(Various Tests)

The arithmetic mean height (Sa value), the transmission density, the ΔL*, the Log HAZE, and the Rspec were measured for each of the single color printing sample and the mixed color printing sample described above. Moreover, the sensory test regarding the film state and the designability was conducted for each sample.

The arithmetic mean height (Sa value) was measured with a shape analysis laser microscope: model number VK-X200 Series (manufactured by KEYENCE Co.) based on ISO-25178 (surface roughness).

The reflection density was measured by a 500 series spectrodensitometer (manufactured by X-Rite Inc.) based on ISO-5/4 (optical system for reflection density measurement).

The transmission density was measured by D200-II transmission densitometer (manufactured by Sakata Inx Eng. Co. Ltd) based on ISO-5/2 (optical system for transmission density measurement).

ΔL* was measured by a spectrocolorimeter CM-512m 3A (manufactured by Konica Minolta Inc.). An axis perpendicular to the measurement sample surface (the surface to be printed) was assumed as 0°, and a light source was placed at each position of 25°, 45°, and 75° at an angle from 0°. The respective brightness, L25, L45, and L75 values, were obtained by reflecting the light emitted from each light source to the surface to be printed and receiving the reflected light from the position of 0°. ΔL* was obtained by calculating the difference between L25 and L75.

Log HAZE was measured at an incident light angle of 20° using a gloss meter appearance analyzer: model number RHOPOINT-IQ (manufactured by Konica Minolta Inc.) based on ISO-13803.

Rspec is a value obtained by measuring peak reflection in a very narrow angle range of the regular reflection direction (20°)±0.0991° when light is irradiated at an incident angle of 20°. It can be said that regular reflection (specular reflection) occurs the higher the value. Rspec was measured with a gloss meter appearance analyzer: model number RHOPOINT-IQ (manufactured by Konica Minolta Inc.) at an incident light angle of 20°.

In the sensory test regarding the film state (color feeling), 12 panelists made the judgement based on whether they felt that each sample was colored to give a color feeling or not, where evaluation was made as "⊙" if eight or more panelists judged that each sample was colored, "○" if five to seven panelists judged that it was colored, and "x" if four or less panelists judged that it was colored.

In the sensory test regarding the design (metal gloss feeling), 12 panelists made the judgement on whether the surface of each sample has metal feeling or not, where evaluation was made as "○" if eight or more panelists judged that the surface has a metal feeling, and "x" if eight or less panelists judged that the surface has a metal feeling.

The above test results are summarized in the table below.

TABLE 4

| | C1-1 | C1-2 | C1-3 | C1-4 | C1-5 | C1-6 | C1-7 | C1-8 |
|---|---|---|---|---|---|---|---|---|
| Sa [μm] | 5.610 | 6.547 | 3.664 | 1.846 | 4.528 | 5.363 | 2.339 | 1.311 |
| Reflection density | 0.70 | 1.55 | 1.78 | 2.2 | 0.90 | 1.86 | 2.06 | 2.27 |
| Transmission density | 0.10 | 0.21 | 0.22 | 0.30 | 0.12 | 0.25 | 0.25 | 0.34 |
| ΔL* | 22.70 | 31.22 | 15.86 | 13.85 | 19.97 | 30.18 | 14.52 | 12.97 |
| LogHAZE | 454 | 163 | 571 | 573 | 521 | 165 | 597 | 597 |
| Rspec [GU] | 3.4 | 0.6 | 4.5 | 5.8 | 3.3 | 0.5 | 7.4 | 10.1 |
| Film state | ○ | x | ⊙ | ⊙ | ⊙ | ⊙ | ⊙ | ⊙ |
| Designability | ○ | x | ○ | ○ | ○ | x | ○ | ○ |

TABLE 5

| | B1-1 | B1-2 | B1-3 | B1-4 |
|---|---|---|---|---|
| Sa [μm] | 5.211 | 1.18 | 5.796 | 1.561 |
| Reflection density | 0.54 | 1.81 | 1.64 | 1.80 |
| Transmission density | 0.23 | 0.75 | 0.71 | 0.73 |
| ΔL* | 16.95 | 6.66 | 30.22 | 6.56 |
| LogHAZE | 582 | 545 | 127 | 463 |
| Rspec [GU] | 4.2 | 11.2 | 0.4 | 17.4 |
| Film state | ○ | ⊙ | x | ⊙ |
| Designability | ○ | x | x | x |

TABLE 6

| | PB1-1 | PB1-2 | PB1-3 | PB1-4 | PB1-5 | PB1-6 |
|---|---|---|---|---|---|---|
| Sa [μm] | 6.496 | 3.205 | 2.344 | 1.106 | 6.155 | 1.170 |
| Reflection density | 0.64 | 0.70 | 0.58 | 1.75 | 1.62 | 1.73 |
| Transmission density | 0.32 | 0.34 | 0.27 | 0.95 | 0.90 | 0.92 |
| ΔL* | 30.27 | 13.36 | 17.74 | 3.87 | 29.38 | 3.84 |
| LogHAZE | 193 | 609 | 651 | 515 | 121 | 469 |
| Rspec [GU] | 0.6 | 5.7 | 7.6 | 14.9 | 0.4 | 18.6 |
| Film state | x | ⊙ | ⊙ | x | x | x |
| Designability | x | ○ | ○ | x | x | x |

Figure 13:
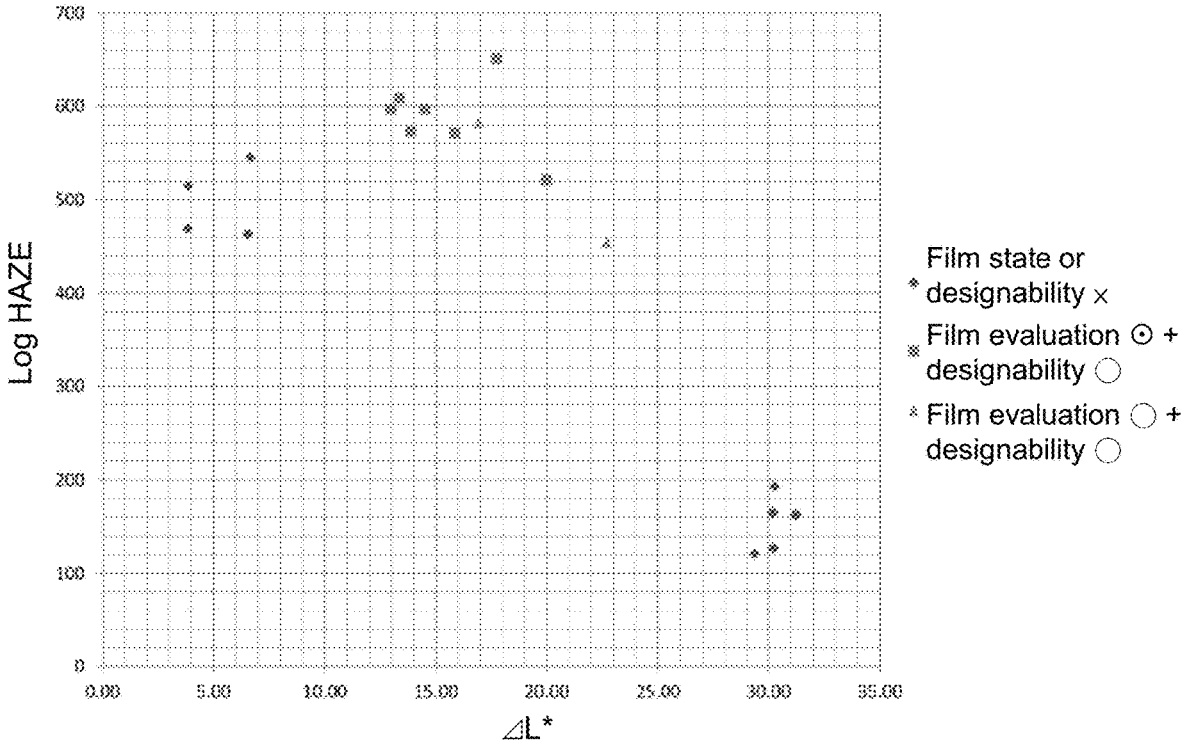
FIG. 13 is a graph showing a relationship between ΔL* and Log HAZE in the first example.

As shown in FIG. 13, Log HAZE was plotted with respect to ΔL* for a sample in which the film state is "⊙" and the designability is "○", a sample in which the film state is "○" and the designability is "○", and a sample in which either the film state or the designability is "x". Furthermore, as shown in FIG. 14, the transmission density was plotted with respect to Sa for these samples.

First, from the results shown in FIG. 13, it was found that the sample in which the film state is "⊙" or "○" and the designability is "○" had Log HAZE of greater than or equal to 400 ΔL* of greater than or equal to 10 and less than or equal to 25.

Figure 14:
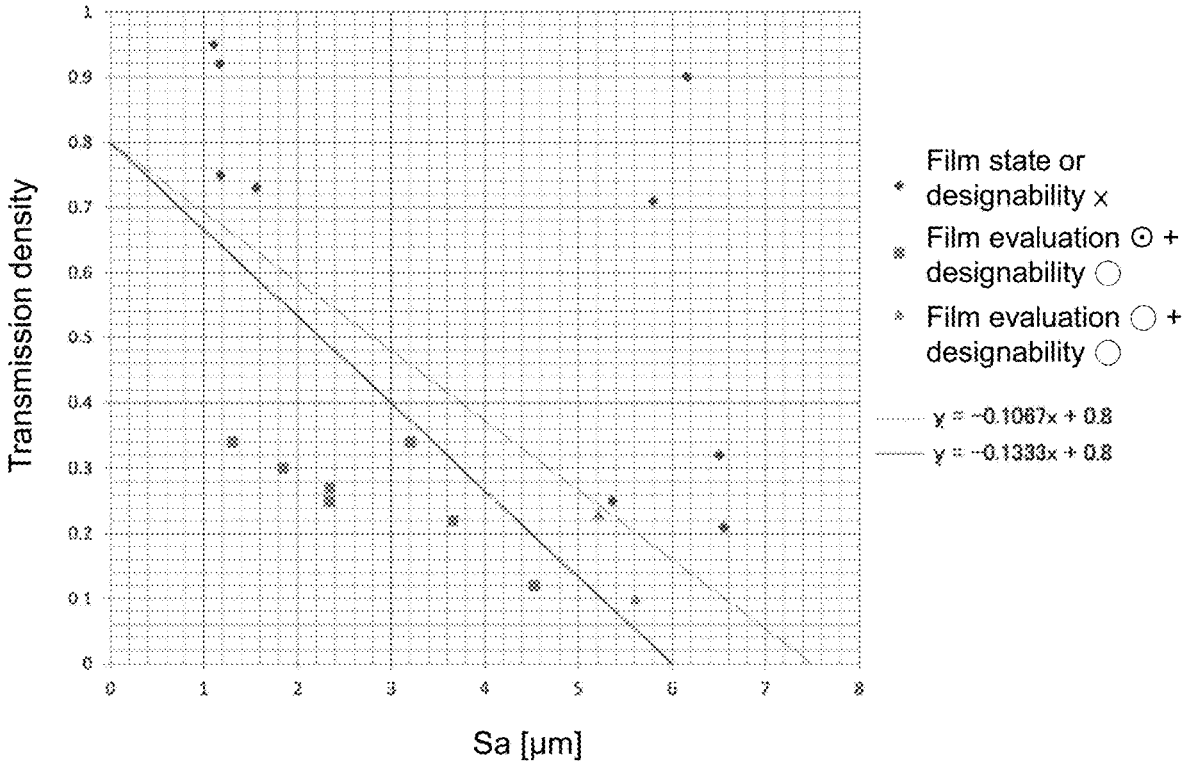
FIG. 14 is a graph showing a relationship between Sa and transmission density in the first example.

Furthermore, from the results in FIG. 14, it was found that for the sample in which the film state is " " and the designability is "○", x and y satisfy a relational expression $y<-8/75x+0.8$, where x is the Sa and y is the transmission density. Moreover, it was found that for the sample in which the film state is "⊙" or "○" and the designability is "○", x and y similarly satisfy the relational expression $y<-2/15x+0.8$.

Comparing the distributions of the sample in which the film state is "⊙" and the designability is "○" and the sample in which the film state is "○" and the designability is "○" in FIGS. 13 and 14, it was found that although it is difficult to distinguish both samples in a specific numerical range in FIG. 13, the samples can be distinguished with a straight line of $y=-2/15x+0.8$ as the boundary in FIG. 14.

Therefore, it was found that color feeling that can withstand practical use can be provided to the metal glossy base while maintaining the metal feeling of the metal glossy base by performing color printing on the metal glossy base so that the arithmetic mean height (Sa) and the transmission density satisfy any of the above-mentioned relational expressions.

The samples of the second example were also subjected to the evaluation tests in the same manner as the first example, and the above test results are summarized in the table below. However, in the second example, the sensory test was not conducted, but the visual confirmation of whether the samples had metal tone glossiness (colored metal tone glossiness) was performed.

TABLE 7

| Evaluation item | Sa [μm] | Transmission density | ΔL* | LogHAZE | Rspec [GU] |
|---|---|---|---|---|---|
| C2-1 | 6.547 | 0.21 | 43.4 | 698 | 9.7 |
| C2-2 | 3.664 | 0.22 | 46.21 | 744 | 29.4 |
| C2-3 | 1.846 | 0.3 | 41.97 | 730 | 23.9 |
| C2-4 | 5.363 | 0.25 | 39.36 | 752 | 5.9 |
| C2-5 | 2.339 | 0.25 | 43.42 | 786 | 20 |
| C2-6 | 1.311 | 0.34 | 35.99 | 795 | 15.7 |
| C2-7 | 7.076 | 0.08 | 48.83 | 428 | 222 |
| C2-8 | 6.838 | 0.16 | 47.73 | 403 | 56.3 |
| C2-9 | 7.262 | 0.08 | 49.04 | 426 | 206 |
| C2-10 | 15.328 | 0.13 | 41.55 | 276 | 140.1 |
| B2-1 | 7.539 | 0.28 | 43.22 | 306 | 57 |
| B2-2 | 1.18 | 0.75 | 28.31 | 473 | 7.8 |
| B2-3 | 5.796 | 0.71 | 27.52 | 359 | 1.5 |
| B2-4 | 1.561 | 0.73 | 25.45 | 532 | 6.7 |
| PB2-1 | 6.496 | 0.32 | 40.55 | 701 | 9.2 |
| PB2-2 | 3.205 | 0.34 | 42.91 | 747 | 24.7 |
| PB2-3 | 1.106 | 0.95 | 11.93 | 648 | 14.5 |
| PB2-4 | 6.155 | 0.9 | 24.32 | 387 | 1.5 |
| PB2-5 | 1.17 | 0.92 | 5.66 | 575 | 26.1 |

Figure 15:
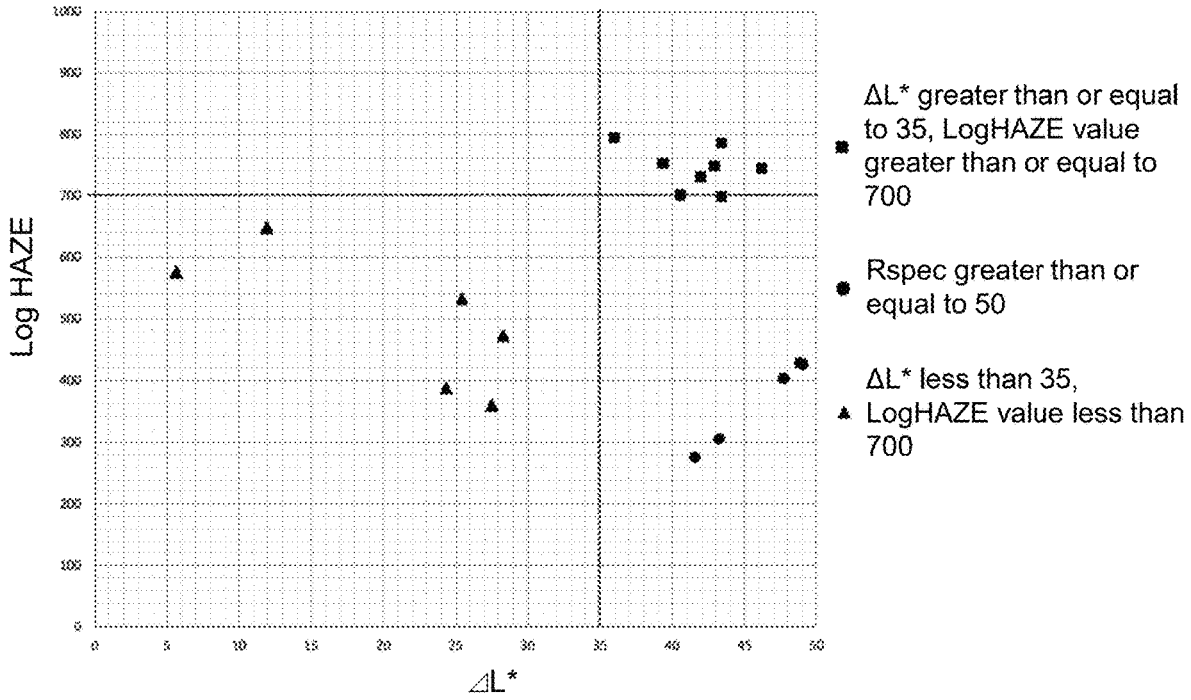
FIG. 15 is a graph showing a relationship between ΔL* and Log HAZE in a second example.

Similar to the first example, Log HAZE of each sample of the second example was plotted with respect to ΔL* as shown in FIG. 15. Furthermore, the transmission density of these samples was plotted with respect to Sa, as shown in FIG. 16.

In FIG. 15, a sample in which the Log HAZE is greater than or equal to 700 and the ΔL* is greater than or equal to 35 is displayed as ■, a sample in which the Log HAZE is less than 700 and the ΔL* is less than 35 is displayed as ▲, and a sample in which the ΔL* is greater than or equal to 35 and the Log HAZE is less than 700 is displayed as ●. The sample (▲) in which the Log HAZE is less than 700 and the ΔL* is less than 35 had no metal tone glossiness. The sample (■) in which the Log HAZE is greater than or equal to 700 and the ΔL* is greater than or equal to 35, and the sample (●) in which the ΔL* is greater than or equal to 35 and the Log HAZE is less than 700 had metal tone glossiness. In particular, it was found that the sample (●) in which the ΔL* is greater than or equal to 35 and the Log HAZE is less than 700 had a metallic feeling (metal tone glossiness) different from the sample in which the Rspec value is greater than or equal to 50 and the Log HAZE is greater than or equal to 700. The sample (■) in which the Log HAZE is greater than or equal to 700 and the ΔL* is greater than or equal to 35 and the sample (●) in which the Log HAZE is less than 700 (Rspec value is greater than or equal to 50) both had colored metal tone glossiness, but the former had a metal tone glossiness of a rough texture (matte tone), whereas the latter had a metal tone glossiness of a smooth texture (mirror surface tone).

Two samples in which color layers were printed in the same ink type and the same print conditions (e.g., dot size, number of dots, UV irradiation interval, etc.) were provided in the first example and the second example (two samples have different materials for the base (metal tone glossy surface) of the color layer CL), and the samples having the colored metal tone glossiness were compared for a plurality of sets for both samples. It was found that in the sample of the second example, the numerical values greatly increased for both the Log HAZE and the ΔL* with respect to the sample of the first example. Furthermore, among the samples in which both the film state and the designability were x in the sensory test in the first example, C2-1 and PB2-1, which are the samples of the second sample under the same print conditions as C1-2 and PB1-1, each had Log HAZE improved to around 700 and ΔL* improved to greater than or equal to 40 compared to C1-2 and PB1-1, respectively, and thus the metal tone gloss feeling is improved and the designability is improved. Thus, if the metal tone gloss feeling of the base is high (e.g., when the surface for forming the color layer is made of metal like the base material 50), the metal tone gloss feeling colored by the color layer can be obtained in some cases even under the print conditions in which the colored metal tone glossiness cannot be obtained when the metal tone gloss feeling of the base is low (e.g., when the metal tone glossy layer is formed with metallic ink like the base material 10).

Figure 16:
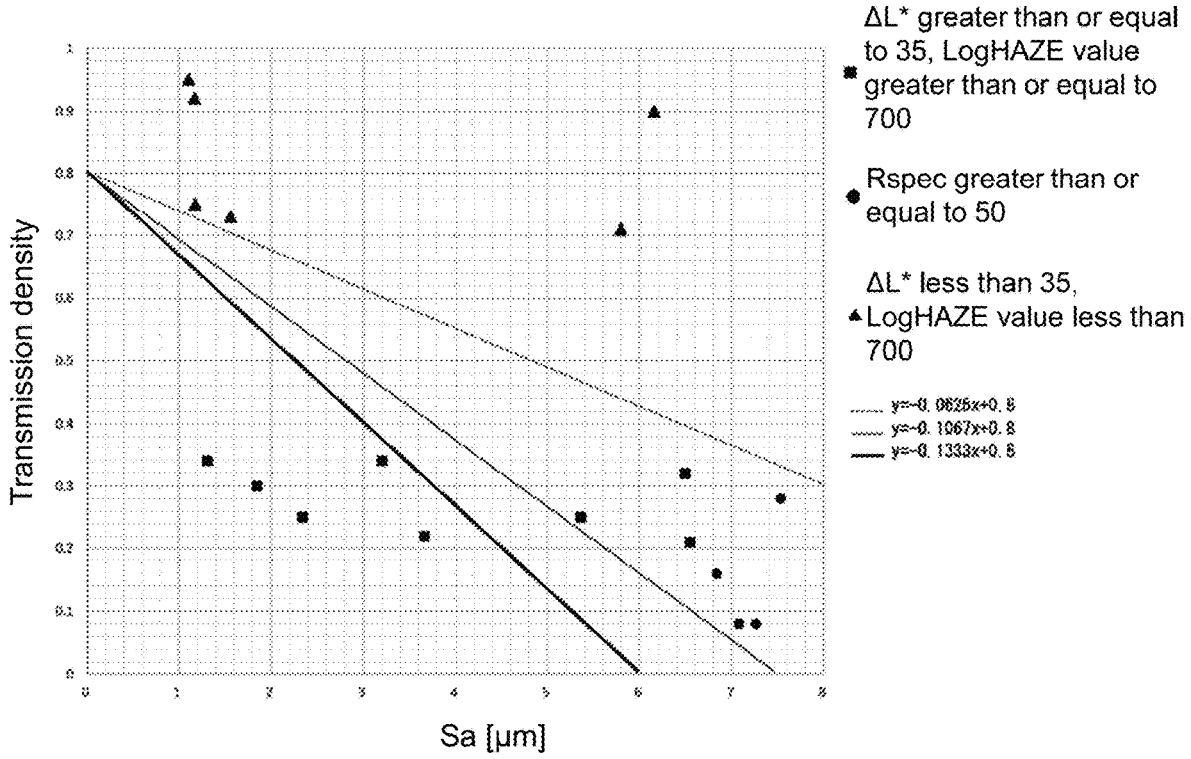
FIG. 16 is a graph showing the relationship between Sa and transmission density in the second example.

Moreover, in FIG. 16, assuming the arithmetic mean height Sa is x and the transmission density is y, it was found that x and y satisfy the relational expression $y<-1/16x+0.8$ in the sample in which the Log HAZE is less than 700 and ΔL* is less than 35 (▲) (i.e., sample (■ and ●) having metal tone glossiness). The above conditions are conditions relieved than the case (refer the result of the first example) in which the color layer is provided on the base material (base material 10 etc.) in which the metal tone glossy layer is formed with metallic ink. That is, it was found that when the color layer is printed on a base material (base material 50 etc.) in which the material of the metal tone glossy surface is a metal, the colored metal tone glossiness can be obtained even if the printing is performed under the condition (conditions of $y<-1/16x+0.8$) relieved than when the color layer is printed on the base material in which the metal tone glossy layer is formed with metallic ink. Furthermore, it was also found that the print conditions of the color layer capable of realizing the colored metal tone glossiness can be differed between the base material in which the metal tone glossy layer is formed of metallic ink and the base material in which the material of the metal tone glossy surface is metal.

Modified Embodiment

When printing a color layer, the color layer is printed under the same conditions as the print conditions of the samples (C2-7 to C2-10, B2-1) in which the Rspec is greater than or equal to 50 for the first region of the base material made of metal, and the color layer is printed under the same conditions as the print conditions of the samples (C2-2 to C2-6, PB2-1 to PB2-2) in which the Log HAZE is greater than or equal to 700 and ΔL* is greater than or equal to 35 for the second region of the base material. In this case, the metal tone glossiness of different textures is obtained in the first region and the second region. The former color layer is leveled after the ink droplets are landed on the base material, and the metal tone glossiness like mirror surface can be expressed by the color layer as the color layer has almost no irregularities. On the other hand, the latter color layer is in a state in which irregularities remained after ink curing, and hence the metal tone glossiness of matte tone which appearance differs depending on the viewing angle can be expressed according to the color layer. Thus, in this example, the metal tone glossiness having different texture can be obtained.

What is claimed is:

1. A printing system, comprising:

a printing mechanism, configured to perform printing with a radiation curable ink through an inkjet method on a metal tone glossy surface having a metal tone glossiness; and a print control section that controls the printing mechanism to print a color layer on the metal tone glossy surface with the printing mechanism, wherein the print control section prints the color layer such that at least a part of the color layer has a thickness that allows transmission of light reflected by the metal tone glossy surface, wherein the print control section acquires at least one print condition among a plurality of print conditions from a storage that stores the plurality of print conditions for printing the color layer that adds color to the metal tone glossiness, wherein the plurality of print conditions comprise:

one or more first print conditions, acquired by the print control section when a base material including the metal tone glossy surface is a first base material including a base member, and a metal tone glossy layer formed on at least a part of the base member with metallic ink and having the metal tone glossy surface; and one or more second print conditions, acquired by the print control section when the base material is a second base material including a metal part forming the metal tone glossy surface, and at least one of the one or more first print conditions and at least one of the one or more second print conditions are different, wherein the one or more first print conditions include a condition for printing the color layer including an arithmetic mean height and a transmission density located in a region below a straight line represented as $y=0.1067x+0.8$ on the coordinates of the arithmetic mean height x and the transmission density y, and the one or more second print conditions include a condition for printing the color layer including an arithmetic mean height and a transmission density located in a region below a straight line represented as $y=0.0625x+0.8$ on the coordinates of the arithmetic mean height x and the transmission density y.

2. The printing system according to claim 1, wherein the print control section prints the color layer based on the acquired at least one print condition.

3. The printing system according to claim 1, wherein the plurality of print conditions is editable by a user, and the print control section prints the color layer based on one or more edited print conditions.

* * * * *